US006786590B2

(12) United States Patent
Maki et al.

(10) Patent No.: US 6,786,590 B2
(45) Date of Patent: Sep. 7, 2004

(54) RECORDING-MEDIUM CONVEYING DEVICE CONVEYING A RECORDING MEDIUM ON A CONVEYING BELT CHARGED WITH A POSITIVE CHARGE AND A NEGATIVE CHARGE ALTERNATELY

(75) Inventors: Tsuneo Maki, Kanagawa (JP); Kazunori Bannai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/092,701

(22) Filed: Mar. 7, 2002

(65) Prior Publication Data

US 2002/0126193 A1 Sep. 12, 2002

(30) Foreign Application Priority Data

Mar. 9, 2001 (JP) ..... 2001-065926
Jul. 23, 2001 (JP) ..... 2001-221049
Dec. 21, 2001 (JP) ..... 2001-388792

(51) Int. Cl.[7] ..... B65H 05/08
(52) U.S. Cl. ..... 347/104; 271/193
(58) Field of Search ..... 347/104; 271/18.1, 271/18.2, 34, 35, 193, 275; 361/234; 399/303; 355/407

(56) References Cited

U.S. PATENT DOCUMENTS 4,178,094 A 12/1979 Silverberg
5,121,170 A * 6/1992 Bannai et al. ..... 271/275
5,255,904 A * 10/1993 Taguchi et al. ..... 271/34
5,530,535 A * 6/1996 Matsuoka ..... 271/273
6,179,419 B1 * 1/2001 Rasmussen et al. ..... 347/104

FOREIGN PATENT DOCUMENTS

| | | |
|---|---|---|
| EP | 0917961 A2 | 5/1999 |
| JP | 3264969 | 11/1991 |
| JP | 4000454 | 1/1992 |
| JP | 4080142 | 3/1992 |
| JP | 4201469 | 7/1992 |
| JP | 9254460 | 9/1997 |
| JP | 200025249 | 1/2000 |
| JP | 2000075772 | 3/2000 |
| JP | 2000191175 | 7/2000 |

* cited by examiner

*Primary Examiner*—Thinh Nguyen
*Assistant Examiner*—Julian D. Huffman
(74) *Attorney, Agent, or Firm*—Cooper & Dunham LLP

(57) ABSTRACT

This recording-medium conveying device comprises a conveying belt, the conveying belt, a belt charging unit, and a pressing roller. The conveying belt is wound around a driving roller and a driven roller so as to convey a recording medium to an image recording part. The conveying belt includes an insulating layer formed at one side contacting the recording medium. The belt charging unit is provided in contact with the insulating layer so as to charge the insulating layer with a positive charge and a negative charge alternately in a moving direction of the conveying belt by applying an AC bias to the conveying belt. The pressing roller presses the conveying belt against the driving roller so as to prevent the conveying belt from slipping on the driving roller.

72 Claims, 20 Drawing Sheets

FIG.25
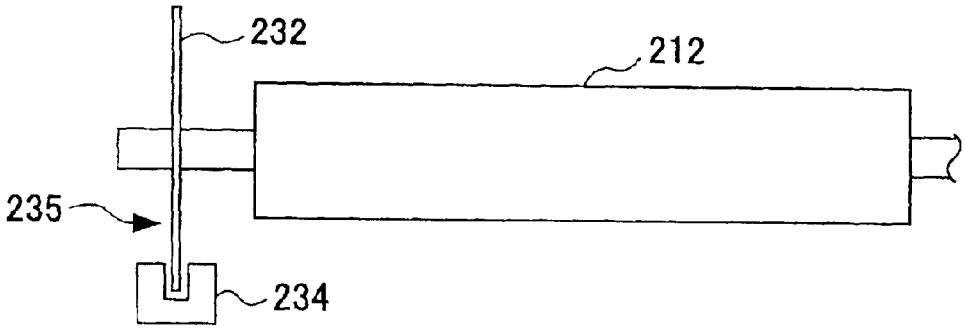
FIG.26A
FIG.26B
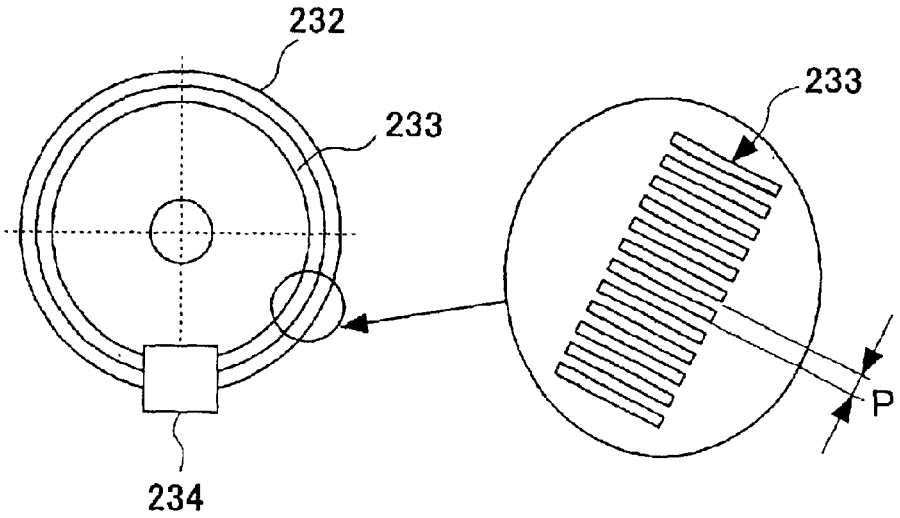

RECORDING-MEDIUM CONVEYING DEVICE CONVEYING A RECORDING MEDIUM ON A CONVEYING BELT CHARGED WITH A POSITIVE CHARGE AND A NEGATIVE CHARGE ALTERNATELY

BACKGROUND OF THE INVENTION

1. Field of the Invention

The present invention generally relates to a conveying device conveying a recording medium, such as a recording sheet, on which an image is printed by jetting a liquid such as an ink thereto, a conveyance control device, and an inkjet recording device printing such an image on the recording medium, and more particularly, to a conveying device which can convey the recording medium with high precision so as to increase a positional precision of applying the liquid onto the recording medium to stably form a high-quality image on the recording medium.

2. Description of the Related Art

A full-colored image can be formed by an electrophotographic method including steps of forming an electrostatic latent image on a photosensitive member, developing each color, and then overlapping the developed colors. However, in performing this method, the step of overlapping the colors is difficult. Further, the method involves complicated component devices including developing devices around the photosensitive member, which enlarges an image-forming device as a whole, and increases costs thereof. By contrast, with an inkjet recording device printing on a recording sheet by jetting ink drops thereon, it is easy to overlap the colors. Additionally, the inkjet recording device has a small recording head jetting the ink drops, which reduces the size of the image-forming device as a whole. Also, the inkjet recording device is excellent in terms of a photographic quality. Further, an image formed on an OHP by the inkjet recording device has an excellent optical transmittance.

In pursuit of a higher-quality image in this inkjet recording device, the ink drops need to be jetted to landing spots on the recording sheet with higher precision. Therefor, not only the recording head jetting the ink drops needs to be further sophisticated in structure, but also the recording sheet needs to be conveyed with higher precision. In a serial printer of an inkjet type, the recording sheet is stopped while the recording head performs a scanning. Accordingly, the recording sheet is repeatedly conveyed and stopped. At this point, a precision of conveying the recording sheet means conveying the recording sheet a predetermined distance, and thereafter stopping the recording sheet at a predetermined position.

For the purpose of enhancing the precision of conveying the recording sheet, in inkjet recording devices disclosed in Japanese Laid-Open Patent Application No. 4-201469, Japanese Laid-Open Patent Application No. 9-254460, and Japanese Laid-Open Patent Application No. 2000-25249, for example, a conveying belt conveying the recording sheet is uniformly charged positively so that the recording sheet is stick fast to the conveying belt by an electrostatic force so as to prevent the recording sheet from being displaced. However, in this state, the ink drops jetted from the recording head are influenced by an electric field such that landing spots of the ink drops are displaced on the recording sheet. For the purpose of preventing this displacement of the landing spots of the ink drops, a negative charge is applied to the conveying belt uniformly charged positively on the surface, in the vicinity of the recording head so as to lessen the electrostatic force so that the ink drops jetted from the recording head are not influenced by the electric field, as described in Japanese Laid-Open Patent Application No. 2000-25249, for example. Additionally, as described in Japanese Laid-Open Patent Application No. 4-201469, for example, a circumferential groove is formed at a predetermined position in an axial direction of a conveying roller, and a projection is formed at a position in a widthwise direction of the conveying belt wound around the conveying roller, the position corresponding to the circumferential groove of the conveying roller, wherein the projection of the conveying belt is engaged in the circumferential groove of the conveying roller so as to regulate the widthwise position of the conveying belt.

However, applying the negative charge, as mentioned above, to the conveying belt in the vicinity of the recording head so as to lessen the electrostatic force necessitates a means therefor, which disadvantageously complicates an entire structure of a conveying device conveying the recording sheet. Additionally, after an image is recorded on the recording sheet by jetting the ink drops thereon, separating the recording sheet from the conveying belt necessitates a separating force that exceeds the electrostatic force applied throughout the surface of the recording sheet, which makes it difficult to provide a separating unit capable of separating the recording sheet. Further, when the conveying belt slips on the conveying roller, the recording sheet is displaced in a direction in which the recording sheet is conveyed by the conveying belt, reducing the precision of conveying the recording sheet.

Additionally, when an image is recorded on the recording sheet by jetting the ink drops thereon, the recording sheet is elongated due to water contained in the ink drops. This phenomenon is referred to as a cockling. Due to this cockling, the recording sheet becomes wavery such that the distance between nozzles of the recording head and the surface of the recording sheet varies depending on the position. When this cockling becomes aggravated, the recording sheet contacts the nozzles of the recording head, at worst, such that the nozzles of the recording head become dirty, and that the recording sheet is smeared. Further, this cockling may displace the landing spots of the ink drops on the recording sheet. In order to prevent these influences of the cockling, an image is formed on a recessed platen by jetting the ink drops from the recording head thereon, while the recording sheet is pressed by a spur having projections on its periphery. However, pressing the recording sheet by the spur may leave a scar on the image formed on the recording sheet, resulting in a deterioration of the image. Also, in order to prevent the above-mentioned influences of the cockling, there is another measure as described in Japanese Laid-Open Patent Application No. 2000-191175. According to this measure, protruding parts and recessing parts are formed on the surface of the conveying belt. The recessing parts are provided with air inflow ports. Vacuum suction is performed via these air inflow ports so as to vacuum-suck the recording sheet to the conveying belt. Thereby, the waves occurring in the recording sheet undergoing the above-mentioned cockling are made lower such that the recording sheet does not contact the recording head.

However, when the recording sheet is vacuum-sucked by the recessing parts of the conveying belt so as to prevent the above-mentioned influences of the cockling of the recording sheet, the recording sheet in the vicinity of the recording head also becomes uneven according to the protruding parts and recessing parts formed on the surface of the conveying belt. This unevenness on the recording sheet displaces the landing spots of the ink drops on the recording sheet, which results in a deteriorated image.

Further, there is also an inkjet recording device comprising a pair of conveying rollers, one of the pair being a combination of the above-mentioned spur and a roller, in which the pair of the conveying rollers convey the recording sheet. In this device, the precision of conveying the recording sheet can be guaranteed only when the recording sheet engages the pair of the conveying rollers. In recent years, there has been a need for an expansion of an image printing area. For the purpose of securing this printing area, there is also an inkjet recording device forming an image in a state that cannot essentially guarantee the precision of conveying the recording sheet, i.e., in a state where the recording sheet engages only either of the pair of the conveying rollers. When an elevation of the recording sheet occurs in this state, the inkjet recording device is unable to deal with this elevation, and cannot secure a force for conveying the recording sheet; thereby, the precision of conveying the recording sheet cannot be guaranteed, and a quality of an image is reduced.

SUMMARY OF THE INVENTION

It is a general object of the present invention to provide an improved and useful recording-medium conveying device, a conveyance control device, and an inkjet recording device, in which the above-mentioned problems are eliminated.

A more specific object of the present invention is to provide a recording-medium conveying device, a conveyance control device, and an inkjet recording device, which can enhance a precision of conveying a recording sheet with a simple configuration, and can expand an printing area of the recording sheet while stably forming a high-quality image.

In order to achieve the above-mentioned objects, there is provided according to one aspect of the present invention a recording-medium conveying device conveying a recording medium to an image recording part, the recording medium being separated and fed from a recording-medium feeding device, the recording-medium conveying device comprising:

a conveying belt wound around a driving roller and a driven roller so as to convey the recording medium to the image recording part, the conveying belt having an insulating layer formed at at least a side contacting the recording medium; and a belt charging unit provided in contact with the conveying belt so as to charge the conveying belt with a positive charge and a negative charge alternately in a moving direction of the conveying belt by applying an AC bias to the conveying belt.

According to the present invention, a micro electric field is induced from the positive charge to the negative charge charged in the conveying belt. This micro electric field causes the recording medium to stick fast electrostatically to the conveying belt. Accordingly, the recording medium can be stably conveyed to the image recording part. Additionally, the recording medium can be conveyed while the evenness of a print surface thereof is maintained without being pressed by a spur, etc. Therefore, not only a high-quality image can be stably formed on the recording medium, but also the print surface of the recording medium can be prevented from being smeared or damaged.

Additionally, in the recording-medium conveying device according to the present invention, the belt charging unit may preferably apply the AC bias to the conveying belt while the conveying belt conveys the recording medium, and the belt charging unit may preferably stop applying the AC bias to the conveying belt while the conveying belt stops conveying the recording medium.

According to the present invention, this function of stopping the application of the AC bias prevents the AC bias from removing the charges charged in the conveying belt, and also prevents charges from being charged in unintended directions.

Additionally, in the recording-medium conveying device according to the present invention, the belt charging unit may apply the AC bias to the conveying belt while the conveying belt is continuously revolved, before the conveying belt conveys the recording medium.

According to the present invention, the positive charge and the negative charge can be stably charged in the conveying belt.

Additionally, in the recording-medium conveying device according to the present invention, the conveying belt may be formed of one layer of the insulating layer, or may be formed of two layers composed of the insulating layer formed at one side contacting the recording medium and a conductive layer formed at the other side not contacting the recording medium.

According to the present invention, the positive charge and the negative charge charged by applying the AC bias can be stably retained in the insulating layer of the conveying belt.

Additionally, in the recording-medium conveying device according to the present invention, the insulating layer may have a volume resistivity equal to or more than $10^{12}$ Ωcm, preferably $10^{15}$ Ωcm.

According to the present invention, the positive charge and the negative charge alternately charged in the insulating layer are prevented from moving across boundaries therebetween so that the insulating layer can be charged stably with the positive charge and the negative charge alternately.

Additionally, the recording-medium conveying device according to the present invention may further comprise conveyance guides provided at both sides of the conveying belt in a widthwise direction thereof so as to guide the recording medium, the conveying belt being formed narrower than the recording medium.

According to the present invention, the conveyance guides prevent an elevation of the recording medium soaking the ink drops, and thereby prevents a displacement of landing spots of the ink drops on the recording medium.

Additionally, in the recording-medium conveying device according to the present invention, the conveyance guides may comprise a plurality of ribs and recession grooves alternately, each of the ribs and the recession grooves being aligned along a conveying direction of the recording medium.

According to the present invention, parts of the elongated recording medium soaking the ink drops sag into the recession grooves where the ribs do not exist. This prevents an elevation of the recording medium soaking the ink drops.

Additionally, the recording-medium conveying device according to the present invention may further comprise a pressing roller pressing the conveying belt against the driving roller by exerting an elastic force so as to prevent the conveying belt from slipping on the driving roller.

According to the present invention, not only the conveying belt is prevented from slipping on the driving roller, the recording medium stuck electrostatically to the conveying belt can be pressed closely against the conveying belt 214 so that the recording medium adheres further firmly to the conveying belt electrostatically.

Additionally, in the recording-medium conveying device according to the present invention, the pressing roller may be provided at a position downstream in a revolving direction of the driving roller.

According to the present invention, the recording medium can be surely stuck fast to the conveying belt at the image recording part including a recording head so as to be conveyed with higher precision.

Additionally, in the recording-medium conveying device according to the present invention, at least the driving roller among the driving roller and the driven roller may have a plurality of projections on a surface thereof. Preferably, the conveying belt may be formed of a timing belt.

According to the present invention, the conveying belt can be more surely prevented from slipping on the driving roller or the driven roller.

In order to achieve the above-mentioned objects, there is also provided according to another aspect of the present invention a recording-medium conveying device conveying a recording medium to an image recording part, the recording medium being separated and fed from a recording-medium feeding device by a separating unit thereof, the recording-medium conveying device comprising:

a conveying belt wound around a driving roller and a driven roller so as to convey the recording medium to the image recording part, the conveying belt having a two-layer structure composed of an insulating layer formed at one side contacting the recording medium and a conductive layer formed at the other side not contacting the recording medium;

a belt charging unit provided in contact with the insulating layer in a vicinity of the separating unit so as to charge the insulating layer with a positive charge and a negative charge alternately in a moving direction of the conveying belt by applying an AC bias to the conveying belt; and a pressing roller pressing the conveying belt against the driving roller by exerting an elastic force so as to prevent the conveying belt from slipping on the driving roller.

In order to achieve the above-mentioned objects, there is also provided according to another aspect of the present invention a recording-medium conveying device conveying a recording medium to an image recording part, the recording medium being separated and fed from a recording-medium feeding device by a separating unit thereof, the recording-medium conveying device comprising:

a conveying belt wound around a central part of a driving roller and a central part of a driven roller so as to convey the recording medium to the image recording part, the conveying belt being narrower than the recording medium, and having a two-layer structure composed of an insulating layer formed at one side contacting the recording medium and a conductive layer formed at the other side not contacting the recording medium;

conveyance guides provided at both sides of the conveying belt in a widthwise direction thereof in the image recording part, the conveyance guides having a plurality of ribs and recession grooves alternately, each of the ribs and the recession grooves being aligned along a conveying direction of the recording medium;

a belt charging unit provided in contact with the insulating layer in a vicinity of the separating unit so as to charge the insulating layer with a positive charge and a negative charge alternately in a moving direction of the conveying belt by applying an AC bias to the conveying belt; and a pressing roller pressing the conveying belt against the driving roller by exerting an elastic force so as to prevent the conveying belt from slipping on the driving roller.

Additionally, in the recording-medium conveying device according to the present invention, a surface of the driving roller may be cured, for example, by being coated with urethane.

In order to achieve the above-mentioned objects, there is also provided according to another aspect of the present invention a recording-medium conveying device conveying a recording medium to an image recording part, the recording medium being separated and fed from a recording-medium feeding device by a separating unit thereof, the recording-medium conveying device comprising:

a conveying belt wound around a driving roller and a driven roller so as to convey the recording medium to the image recording part, the conveying belt having a two-layer structure composed of an insulating layer formed at one side contacting the recording medium and a conductive layer formed at the other side not contacting the recording medium; and a belt charging unit provided in contact with the insulating layer in a vicinity of the separating unit so as to charge the insulating layer with a positive charge and a negative charge alternately in a moving direction of the conveying belt by applying an AC bias to the conveying belt, wherein at least one of the driving roller and the driven roller is a grip roller having a plurality of projections.

In order to achieve the above-mentioned objects, there is also provided according to another aspect of the present invention a recording-medium conveying device conveying a recording medium to an image recording part, the recording medium being separated and fed from a recording-medium feeding device by a separating unit thereof, the recording-medium conveying device comprising:

a conveying belt wound around a central part of a driving roller and a central part of a driven roller so as to convey the recording medium to the image recording part, the conveying belt being narrower than the recording medium, and having a two-layer structure composed of an insulating layer formed at one side contacting the recording medium and a conductive layer formed at the other side not contacting the recording medium;

conveyance guides provided at both sides of the conveying belt in a widthwise direction thereof in the image recording part, the conveyance guides having a plurality of ribs and recession grooves alternately, each of the ribs and the recession grooves being aligned along a conveying direction of the recording medium; and a belt charging unit provided in contact with the insulating layer in a vicinity of the separating unit so as to charge the insulating layer with a positive charge and a negative charge alternately in a moving direction of the conveying belt by applying an AC bias to the conveying belt, wherein at least one of the driving roller and the driven roller is a grip roller having a plurality of projections.

In order to achieve the above-mentioned objects, there is also provided according to another aspect of the present invention a recording-medium conveying device conveying a recording medium to an image recording part, the recording medium being separated and fed from a recording-medium feeding device by a separating unit thereof, the recording-medium conveying device comprising:

a conveying belt wound around a driving roller and a driven roller so as to convey the recording medium to the image recording part, the conveying belt having a two-layer structure composed of an insulating layer formed at one side contacting the recording medium and a timing belt formed by a conductive layer at the other side not contacting the recording medium; and a belt charging unit provided in contact with the insulating layer in a vicinity of the separating unit so as to charge the insulating layer with a positive charge and a negative charge alternately in a moving direction of the conveying belt by applying an AC bias to the conveying belt.

In order to achieve the above-mentioned objects, there is also provided according to another aspect of the present invention a recording medium to an image recording part, the recording medium being separated and fed from a recording-medium feeding device by a separating unit thereof, the recording-medium conveying device comprising:

a conveying belt wound around a central part of a driving roller and a central part of a driven roller so as to convey the recording medium to the image recording part, the conveying belt being narrower than the recording medium, and having a two-layer structure composed of an insulating layer formed at one side contacting the recording medium and a timing belt formed by a conductive layer at the other side not contacting the recording medium; and conveyance guides provided at both sides of the conveying belt in a widthwise direction thereof in the image recording part, the conveyance guides having a plurality of ribs and recession grooves alternately, each of the ribs and the recession grooves being aligned along a conveying direction of the recording medium; and a belt charging unit provided in contact with the insulating layer in a vicinity of the separating unit so as to charge the insulating layer with a positive charge and a negative charge alternately in a moving direction of the conveying belt by applying an AC bias to the conveying belt.

Additionally, in the recording-medium conveying device according to the present invention, the timing belt may be formed at at least a part of the other side of the conveying belt.

Additionally, in the recording-medium conveying device according to the present invention, one of the driving roller and the driven roller positioned upstream in the conveying direction of the recording medium may have a large diameter, and the other of the driving roller and the driven roller positioned downstream in the conveying direction of the recording medium may have a small diameter.

In order to achieve the above-mentioned objects, there is also provided according to another aspect of the present invention a recording-medium conveying device conveying a recording medium to an image recording part, the recording medium being separated and fed from a recording-medium feeding device, the recording-medium conveying device comprising:

a conveying belt wound around a driving roller and a driven roller, the driving roller being connected to a ground, so as to convey the recording medium to the image recording part, the conveying belt having an insulating layer formed at a side contacting the recording medium;

a belt charging unit provided opposite the driving roller at a position upstream in a revolving direction of the driving roller from a position at which the recording medium fed from the recording-medium feeding device contacts the conveying belt wound around the driving roller so as to charge the conveying belt with a positive charge and a negative charge alternately in a moving direction of the conveying belt by applying an AC bias to the conveying belt; and a pressing roller provided opposite the driving roller at a position downstream in the revolving direction of the driving roller from the belt charging unit so as to press the recording medium stuck fast to the conveying belt closely to the conveying belt.

According to the present invention, the recording medium can be conveyed stably.

Additionally, in the recording-medium conveying device according to the present invention, the AC bias may impressed to the belt charging unit when the recording medium is conveyed. Further, the AC bias is preferred to be stopped being impressed to the belt charging unit when the recording medium is stopped being conveyed.

Alternatively, in the recording-medium conveying device according to the present invention, the AC bias may be impressed to the belt charging unit while the conveying belt is continuously revolved, before the recording medium is conveyed.

In order to achieve the above-mentioned objects, there is also provided according to another aspect of the present invention a conveyance control device controlling one of the above-mentioned recording-medium conveying devices, the conveyance control device comprising:

a binary scale provided on a part of the conveying belt along the moving direction thereof, wherein one of a reflected light and a transmitted light from the binary scale is detected so as to control a revolving velocity and a stopping position of the driving roller.

Additionally, the conveyance control device according to the present invention may further comprise an optical sensor provided opposite a part of the conveying belt downstream from and near the driving roller so as to detect one of the reflected light and the transmitted light. Alternatively, the conveyance control device according to the present invention may further comprise an optical sensor provided opposite a part of the conveying belt corresponding to the image recording part so as to detect the reflected light.

In order to achieve the above-mentioned objects, there is also provided according to another aspect of the present invention a conveyance control device controlling one of the above-mentioned recording-medium conveying devices, the conveyance control device comprising:

a conveyance distance detecting unit detecting one of a conveyance speed and a conveyance distance of the conveying belt; and a conveying-belt driving unit driving the driving roller, wherein the conveying-belt driving unit is controlled according to one of the conveyance speed and the conveyance distance detected by the conveyance distance detecting unit.

According to the present invention, the recording medium can be conveyed at a conveyance speed optimum for an image formation.

Additionally, in the conveyance control device according to the present invention, the conveyance distance detecting unit may comprise:

a binary scale provided on one of an outer surface and an inner surface of the conveying belt; and a read sensor reading the binary scale, wherein the binary scale has pitches arranged at an interval corresponding to a value obtained by dividing a maximum resolution of an image to be recorded on the recording medium by n, where n is an integer larger than zero.

Additionally, in the conveyance control device according to the present invention, the conveyance distance detecting unit may comprise an encoder provided on a rotary shaft of the driving roller, wherein the driving roller has a diameter determined such that a conveyance distance of the conveying belt corresponding to one pulse output by the encoder becomes a value obtained by dividing a maximum resolution of an image to be recorded on the recording medium by n, where n is an integer larger than zero.

According to the present invention, the feed distance (the conveyance distance) of the conveying belt electrostatically absorbing the recording medium can be controlled according to a unit distance corresponding to the maximum resolution. Accordingly, in an inkjet printer of a serial type, a precision of starting a new print line can be controlled with high precision, and in an inkjet printer of a line type, a speed of starting a new print line can be controlled with high precision. Therefore, a high-quality image can be stably formed on the recording medium.

In order to achieve the above-mentioned objects, there is also provided according to another aspect of the present invention an inkjet recording device comprising:

a recording head (mounted on a carriage) in an image recording part so as to record an image by jetting ink drops on a recording medium;

a recording-medium feeding device containing the recording medium, and separating and feeding the recording medium one by one therefrom by a separating unit thereof; and one of the above-mentioned recording-medium conveying devices.

In order to achieve the above-mentioned objects, there is also provided according to another aspect of the present invention an inkjet recording device comprising:

a recording head mounted on a carriage in an image recording part so as to record an image by jetting ink drops on a recording medium;

a recording-medium feeding device containing the recording medium, and separating and feeding the recording medium one by one therefrom; and one of the above-mentioned recording-medium conveying devices.

Other objects, features and advantages of the present invention will become more apparent from the following detailed description when read in conjunction with the accompanying drawings.

BRIEF DESCRIPTION OF THE DRAWINGS

FIG. 25 is an illustration of a configuration of a rotary encoder provided on a rotary shaft of the driving roller shown in FIG. 18;

FIG. 26A and FIG. 26B are a front view and a magnified view of an arrangement of a scale provided on a disc included in the rotary encoder shown in FIG. 25;

DETAILED DESCRIPTION OF THE PREFERRED EMBODIMENTS

A description will now be given, with reference to the drawings, of embodiments according to the present invention.

[Embodiments 1–4]

Figure 1:
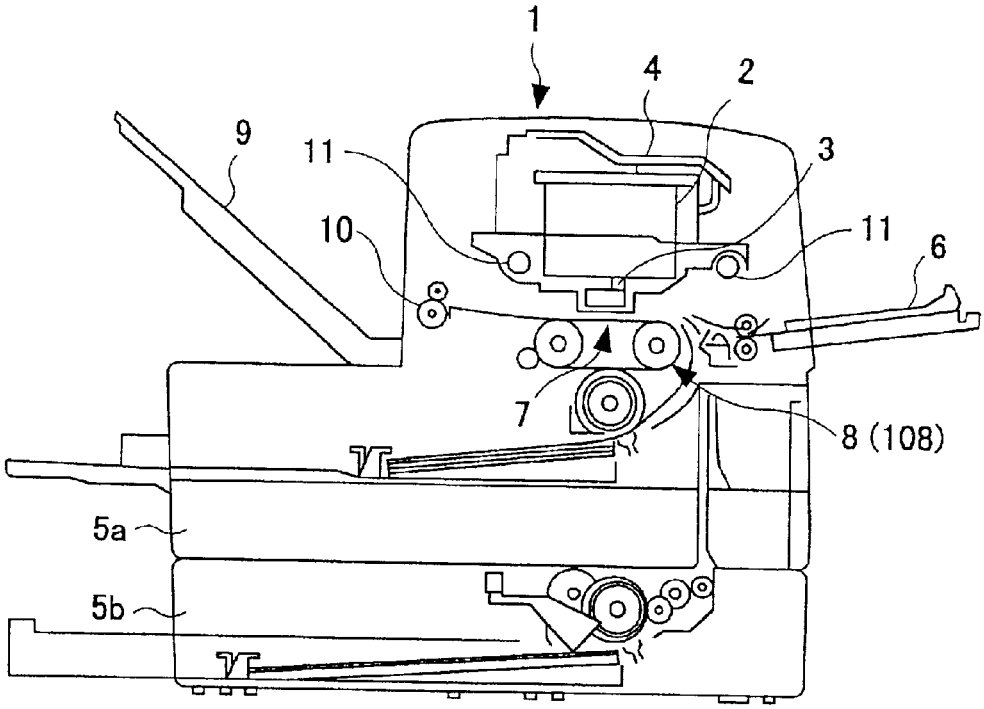
FIG. 1 is an illustration of a configuration of an inkjet printer according to a first embodiment of the present invention.

FIG. 1 is an illustration of a configuration of an inkjet printer according to a first embodiment of the present invention. As shown in FIG. 1, an inkjet printer 1 comprises four ink cartridges 2, four recording heads 3, a carriage 4, feeding trays 5*a* and 5*b*, a manual feeding tray 6, a recording-sheet conveying device 8, a delivery tray 9, and a delivery roller 10. The four ink cartridges 2 contain four inks of cyan C, magenta M, yellow Y, and black Bk, respectively. The four recording heads 3 have a plurality of nozzles, and are supplied with the inks from the four ink cartridges 2, respectively. The ink cartridges 2 and the recording heads 3 are mounted on the carriage 4. The feeding trays 5*a* and 5*b* contain recording sheets. The feeding trays 5*a* and 5*b* and the manual feeding tray 6 form a recording-medium feeding device. The recording-sheet conveying device 8 conveys a recording sheet from the feeding trays 5*a*, 5*b*, or the manual feeding tray 6 to a printing part (an image recording part) 7 including the recording heads 3. The delivery roller 10 delivers a printed recording sheet to the delivery tray 9. Upon printing image data transmitted from a host device on the recording sheet, ink drops are jetted from the nozzles of the recording heads 3 on the recording sheet according to the image data so as to record a character or an image, while the carriage 4 performs a scanning guided by carriage guide rollers 11. In this course, the recording sheet is conveyed to the printing part 7 by the recording-sheet conveying device 8.

Figure 2:
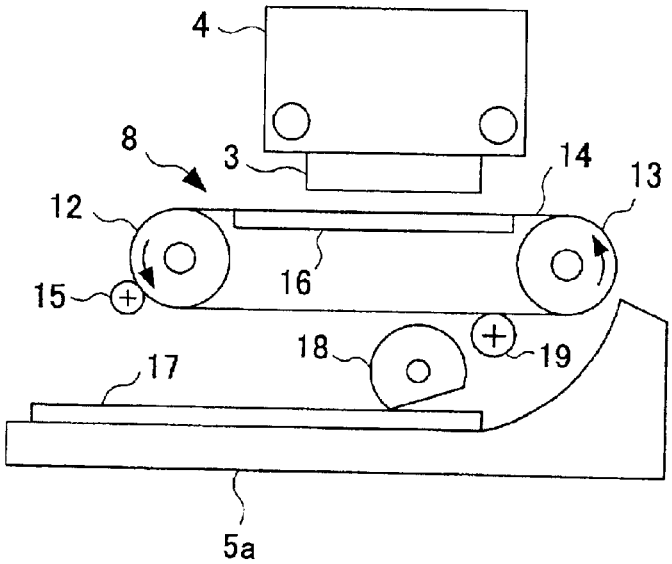
FIG. 2 is an illustration of a configuration of a recording-sheet conveying device shown in FIG. 1.
Figure 3:
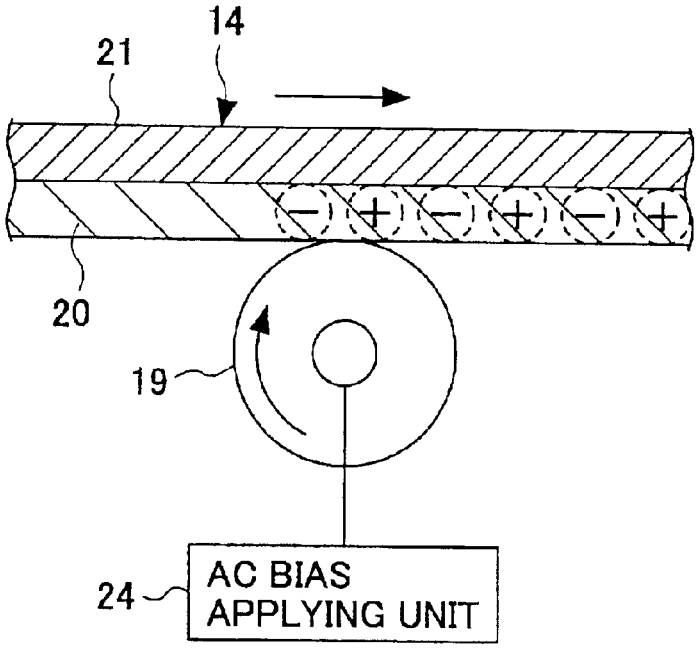
FIG. 3 is a cross-sectional view of a structure of a conveying belt shown in FIG. 2.

As shown in FIG. 2, the recording-sheet conveying device 8 comprises a conveying belt 14, a pressing roller 15, conveyance guides 16, and a belt charging roller (a belt charging unit) 19. The conveying belt 14 is wound around a driving roller 12 and a driven roller 13, and is capable of moving back and forth. The pressing roller 15 presses the conveying belt 14 against the driving roller 12 by exerting an elastic force of an elastic material such as a spring so as to prevent the conveying belt 14 from slipping on the driving roller 12. The conveyance guides 16 are arranged between the driving roller 12 and the driven roller 13 along a stretch nearer to the recording heads 3. A separating unit 18 separates and feeds a recording sheet 17 from other recording sheets contained in the feeding tray 5*a*. The belt charging roller 19 is so arranged in the vicinity of the separating unit 18 as to contact the conveying belt 14. As shown in FIG. 3, the conveying belt 14 has a two-layer structure composed of an insulating layer 20 and a conductive layer 21. The insulating layer 20 is formed at the outer side of the two-layer structure contacting the recording sheet 17 and the belt charging roller 19. The conductive layer 21 is formed at the inner side of the two-layer structure not contacting the recording sheet 17 or the belt charging roller 19. As shown in a sectional view of FIG. 4A and a top view of FIG. 4B, the conveying belt 14 is narrower than the recording sheet 17, and is wound around central parts of the driving roller 12 and the driven roller 13. The conveyance guides 16 are arranged at both sides of the conveying belt 14 in a widthwise direction thereof, and have a plurality of ribs 22 and recession grooves 23 arranged alternately. Each of the ribs 22 and the recession grooves 23 is aligned along a direction (a conveying direction of the recording sheet 17) in which the recording sheet 17 is conveyed. As shown in FIG. 3, the belt charging roller 19 is connected to an AC bias applying unit 24 applying an AC bias of, for example, 2 kV to 3 kV.

Figure 5:
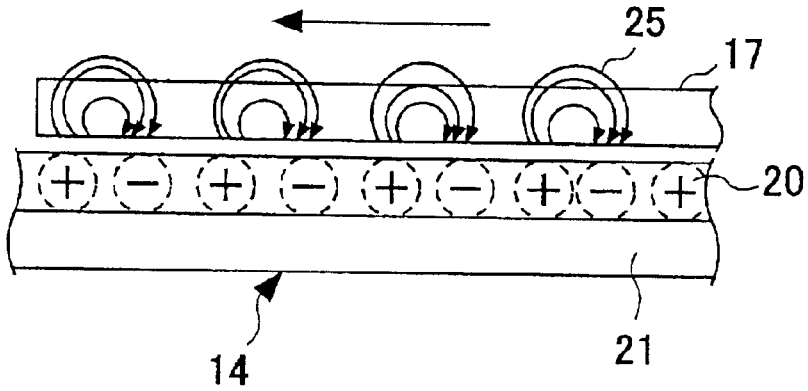
FIG. 5 is an illustration of micro electric fields generated by electric charges charged in the conveying belt.

When the inkjet printer 1 receives an instruction for outputting an image, the driving roller 12 of the recording-sheet conveying device 8 is revolved by a driving motor (not shown in the figures) so that the conveying belt 14 is revolved counterclockwise. At the same time, the AC bias is applied from the AC bias applying unit 24 to the belt charging roller 19. By this AC bias applied to the belt charging roller 19, the insulating layer 20 of the conveying belt 14 is charged with positive charges and negative charges alternately in a direction (a moving direction of the conveying belt 14) in which the conveying belt 14 moves, as shown in FIG. 3. When the recording sheet 17 separated and fed by the separating unit 18 contacts the conveying belt 14, the recording sheet 17 is subjected to electrostatic forces originating from micro electric fields 25 each induced from the positive charge to the negative charge charged in the insulating layer 20 of the conveying belt 14, as shown in FIG. 5. These electrostatic forces cause a central part of the recording sheet 17 to stick fast to the conveying belt 14. Therefor, the belt charging roller 19 charging the conveying belt 14 positively and negatively is arranged in the vicinity of the separating unit 18 feeding the recording sheet 17 from the feeding tray 5*a*; thereby, the micro electric fields 25 are surely generated so that the recording sheet 17 is stably stuck fast to the conveying belt 14.

The recording sheet 17 stuck fast to the conveying belt 14 is conveyed to the printing part 7 as the conveying belt 14 revolves. Then, when an image formation area at a leading part of the recording sheet 17 reaches a position right under the recording heads 3, the driving roller 12 is stopped revolving so that the conveying belt 14 is stopped revolving. In this state where the recording sheet 17 is stopped, ink drops are jetted from the recording heads 3 while the recording heads 3 are moved back and forth in scanning directions by the carriage 4 so as to form an image on the recording sheet 17. Then, when this image formation for the image formation area at the leading part of the recording sheet 17 is completed, the driving roller 12 is restarted so as to revolve the conveying belt 14. The recording sheet 17 is conveyed until a following image formation area of the recording sheet 17 reaches the position right under the recording heads 3. Thereupon, the driving roller 12 is stopped revolving so as to stop the conveying belt 14. In this state, an image is formed on the following image formation area of the recording sheet 17. Thus, the conveying belt 14 repeats the conveyance and stoppage of the recording sheet 17 so as to form an image on the recording sheet 17.

While the conveyance and stoppage of the recording sheet 17 is repeated so as to form an image on the recording sheet 17, the recording sheet 17 is stuck fast to the conveying belt 14 by the electrostatic forces originating from the micro electric fields 25. Furthermore, the conveying belt 14 is constantly pressed against the driving roller 12 by the pressing roller 15 so as to increase a frictional force between the driving roller 12 and the conveying belt 14 to prevent the conveying belt 14 from slipping on the driving roller 12. Accordingly, the recording sheet 17 can be conveyed and stopped with precision. Additionally, the recording sheet 17 is stuck fast to the conveying belt 14 by the electrostatic forces originating from the micro electric fields 25 discontinuously generated by the positive charges and the negative charges charged alternately in the conveying belt 14 at a constant interval of 4 mm, for example. This eliminates influences of the electrostatic forces otherwise posed on the ink drops jetted from the recording heads 3 so that the ink drops are jetted onto predetermined landing spots. Thereby, a high-quality image without positional displacement can be stably formed on the recording sheet 17.

Figure 4A:
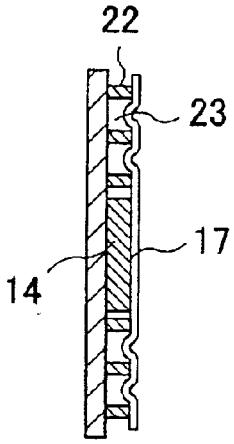
FIG. 4A and FIG. 4B are a sectional view and a top view including the conveying belt and conveyance guides shown in FIG. 2.
Figure 4B:
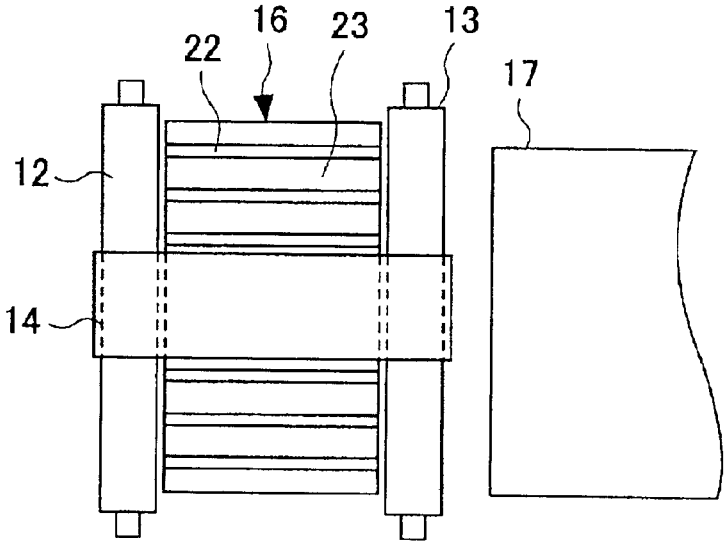

While the ink drops are jetted from the recording heads 3 onto the recording sheet 17 so as to form an image thereon, the ink drops permeate the recording sheet 17 so that the recording sheet 17 is elongated, causing a cockling in the recording sheet 17. However, this elongated recording sheet 17 is kept at its original height by the ribs 22 of the conveyance guides 16 whereas other parts of the elongated recording sheet 17 sags into the recession grooves 23 where the ribs 22 do not exist, as shown in FIG. 4A. This prevents an elevation of the recording sheet 17 soaking the ink drops. Accordingly, this prevents influences of the cockling from displacing the landing spots of the ink drops on the recording sheet 17. This also prevents the recording sheet 17 from contacting the nozzles of the recording heads 3; thereby, the nozzles of the recording heads 3 are prevented from becoming dirty, and the recording sheet 17 is prevented from being smeared. Accordingly, a high-quality image can be stably formed on the recording sheet 17.

This recording sheet 17 on which an image is formed as described above is conveyed downstream from the recording heads 3 by the conveying belt 14. When the conveying belt 14 changes its direction around the driving roller 12, the recording sheet 17 is separated from the conveying belt 14 by its own rigidity toward the delivery roller 10. In this course, the recording sheet 17 can be easily separated from the conveying belt 14 without a need for a complicated recording-sheet separation mechanism, because the recording sheet 17 is stuck to the conveying belt 14 only by the electrostatic forces originating from the micro electric fields 25 discontinuously generated by the positive charges and the negative charges charged alternately in the conveying belt 14 at a constant interval. In addition, since only the discontinuously generated micro electric fields 25 are applied to the recording sheet 17, the electrostatic forces are prevented from remaining in the delivered recording sheet 17.

Figure 6:
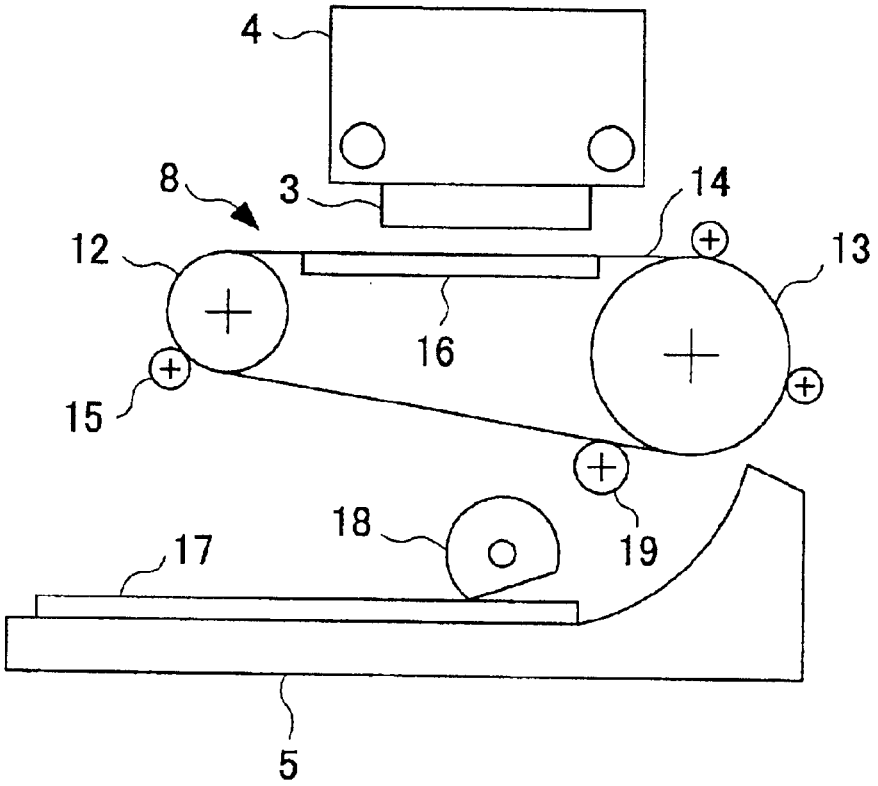
FIG. 6 is an illustration of a configuration of a recording-sheet conveying device according to a second embodiment of the present invention.

The above-described first embodiment sets forth an example where the driving roller 12 and the driven roller 13 have substantially the same diameter. However, as in a second embodiment of the recording-sheet conveying device 8 shown in FIG. 6, it is preferred that the driven roller 13 provided near the separating unit 18 has a large diameter and the driving roller 12 provided near the delivery roller 10 has a small diameter. Enlarging the diameter of the driven roller 13, which is provided at a side where the recording sheet 17 is stuck to the conveying belt 14, increases a radius of curvature at which the conveying belt 14 changes its direction so as to decrease a bending stress imposed on the recording sheet 17 stuck fast thereto. Thereby, the recording sheet 17 stuck fast to the conveying belt 14 can be bent naturally from the leading part of the recording sheet 17 so that the recording sheet 17 can be conveyed stably. On the other hand, decreasing the diameter of the driving roller 12, which is provided on a side where the recording sheet 17 is separated from the conveying belt 14, reduces a radius of curvature at which the conveying belt 14 changes its direction. Accordingly, the recording sheet 17 can be easily separated from the conveying belt 14 by its own rigidity.

Figure 7:
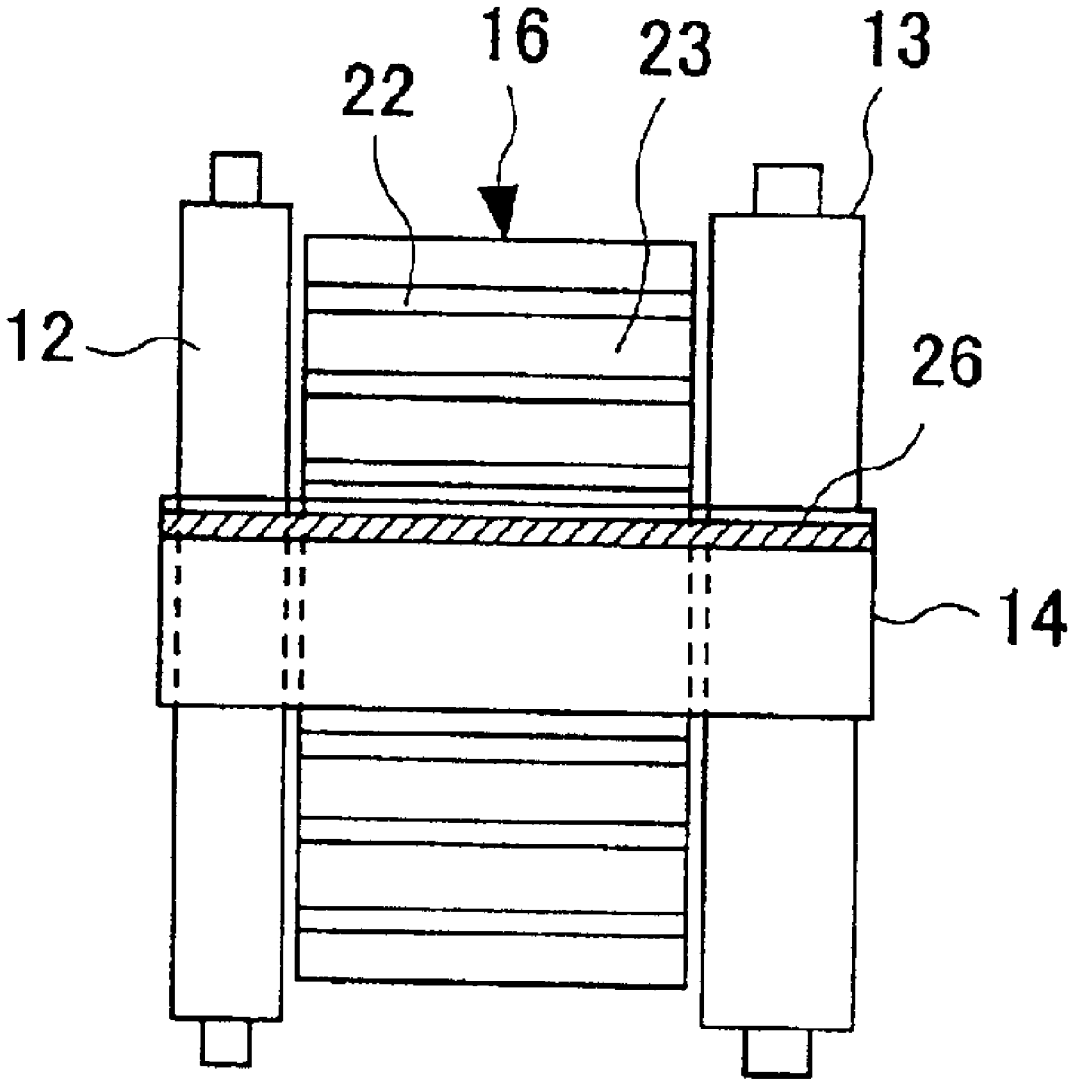
FIG. 7 is an illustration of a configuration of a recording-sheet conveying device according to a third embodiment of the present invention.
Figure 8A:
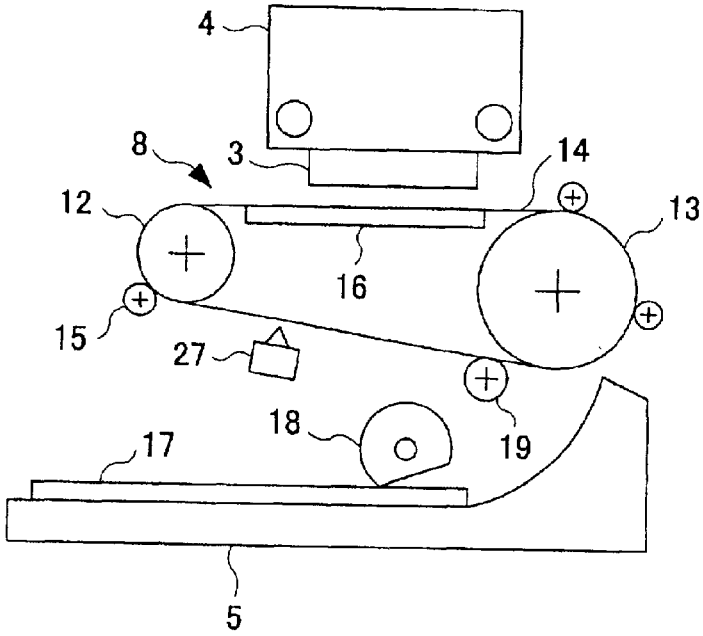
FIG. 8A is an illustration of a first arrangement of an optical sensor provided in the recording-sheet conveying device shown in FIG. 7.
Figure 8B:
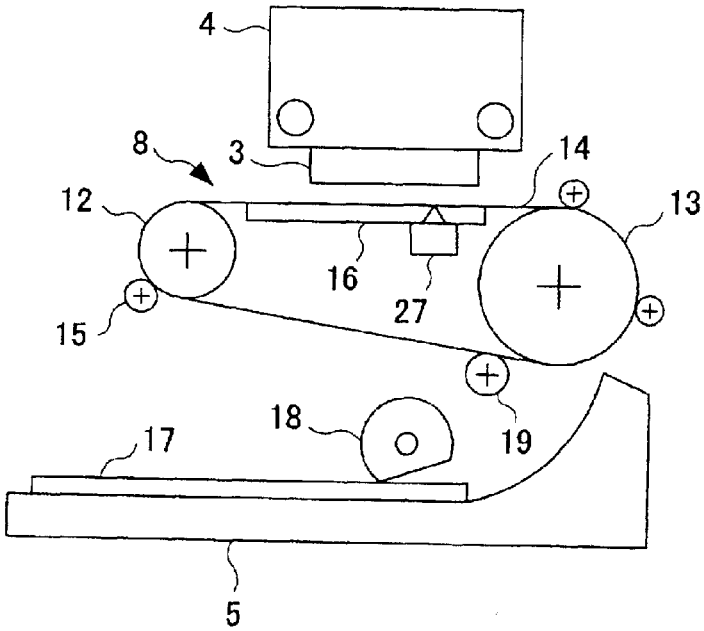
FIG. 8B is an illustration of a second arrangement of the optical sensor provided in the recording-sheet conveying device shown in FIG. 7.
Figure 9:
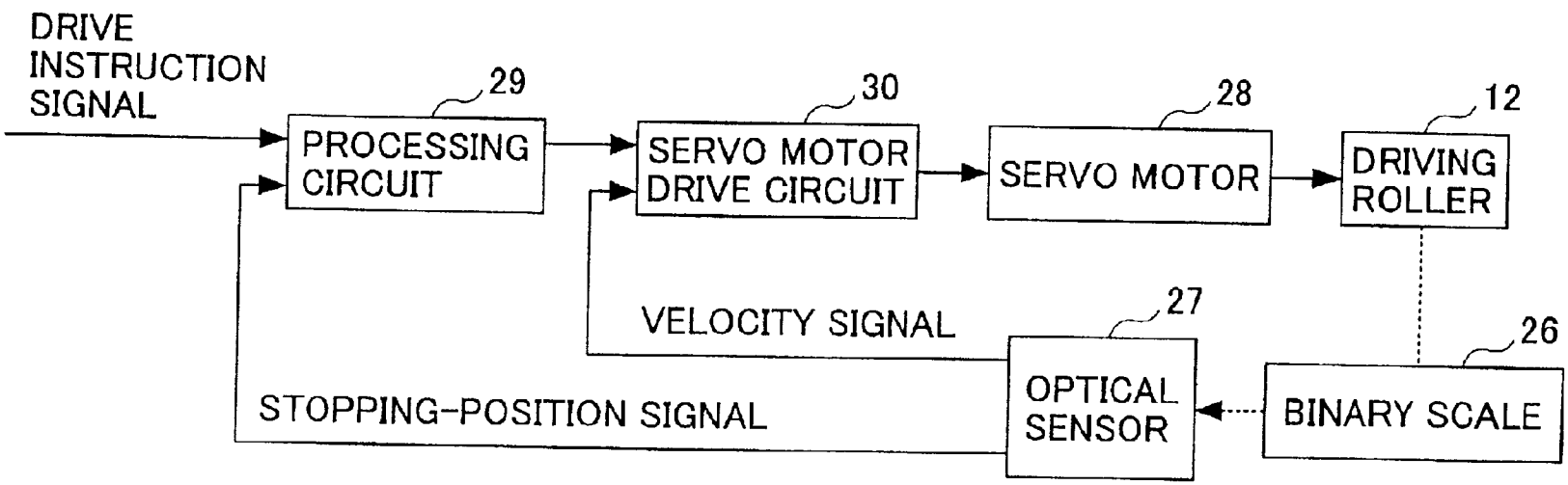
FIG. 9 is a block diagram of a control unit for controlling a driving roller shown in FIG. 7.
Figure 10:
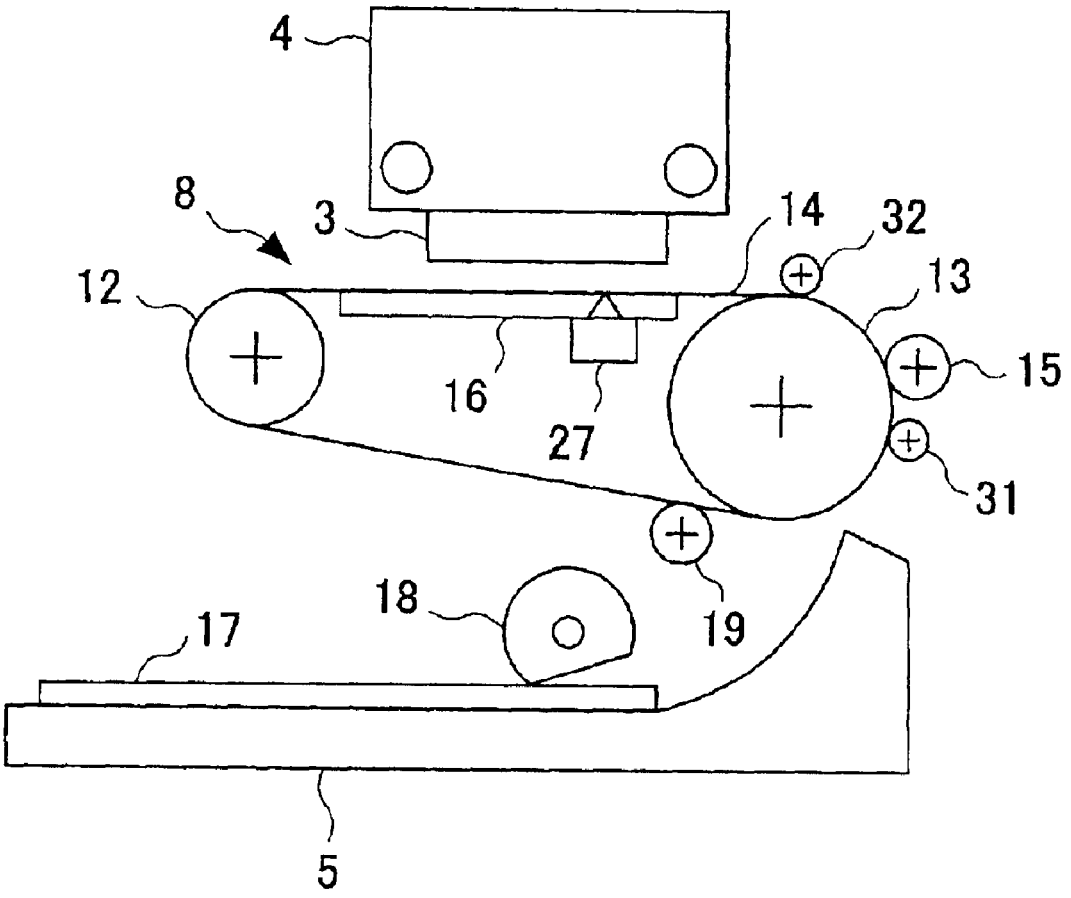
FIG. 10 is an illustration of a configuration of a recording-sheet conveying device according to a fourth embodiment of the present invention.

When the conveying belt 14 conveys the recording sheet 17 stuck fast thereto to right under the recording heads 3, and intermittently repeats the revolution and stoppage thereof, the conveying belt 14 needs to be controlled to stop at a precise position. Therefor, for example, as in a third embodiment of the recording-sheet conveying device 8 shown in FIG. 7, periodical bumps and dents may be formed on a part of the conveying belt 14 at an interval selected from a range of 10 $\mu$m to 100 $\mu$m in accordance with a precision required in conveying the recording sheet 17, or a binary scale 26 having periodically changing optical reflectance and transmittance may be provided on a part of the conveying belt 14. Then, a light reflected on the binary scale 26 may be detected by an optical sensor 27 of a reflection type or a transmission type provided at a part free from influences of an extension of the conveying belt 14 downstream from the driving roller 12, as shown in FIG. 8A, or of a transmission type provided in the vicinity of the printing part 7, as shown in FIG. 8B, so as to control the revolution and stoppage of the driving roller 12. For example, the revolution and stoppage of the driving roller 12 can be controlled by a control unit (a conveyance control device) 40 shown in a block diagram of FIG. 9. In FIG. 9, a processing circuit 29 receives a drive instruction signal, and computes a revolving velocity and a stopping position of a servomotor 28 revolving and stopping the driving roller 12. In this course, a stopping-position signal is transmitted from the optical sensor 27 to the processing circuit 29 so as to control the stopping position. Also, a velocity signal is transmitted from the optical sensor 27 to a servomotor drive circuit 30 driving the servomotor 28 so as to control the revolving velocity of the servomotor 28 at a constant velocity. Thus, by controlling the revolving velocity and the stopping position of the servomotor 28 revolving and stopping the driving roller 12, the recording sheet 17 stuck fast to the conveying belt 14 can be controlled to stop at a precise position, and therefore, a stable image can be formed. In addition, by using the binary scale 26 provided on the conveying belt 14 to directly detect a conveyance distance of the conveying belt 14 so as to control the revolution of the driving roller 12 as described above, the pressing roller 15 may be provided between a sheet conveying roller 31 and a pressuring roller 32, as in a fourth embodiment of the recording-sheet conveying device 8 shown in FIG. 10, so as to prevent the conveying belt 14 from slipping on the driven roller 13.

Additionally, in the embodiments according to the present invention, the conveying belt 14 is pressed against the driving roller 12 or the driven roller 13 by the pressing roller 15 so as to prevent the conveying belt 14 from slipping on the driving roller 12 or the driven roller 13 to increase a positional precision of stopping the conveying belt 14. Furthermore, the surface of the driving roller 12 or the driven roller 13 may be subjected to a curing process, such as a urethane coating, so as to increase the frictional force between the driving roller 12 or the driven roller 13 and the conveying belt 14 to surely prevent the conveying belt 14 from slipping on the driving roller 12 or the driven roller 13. Thereby, the recording sheet 17 not only can be stably conveyed, but also can be controlled to stop at a precise position.

Figure 11:
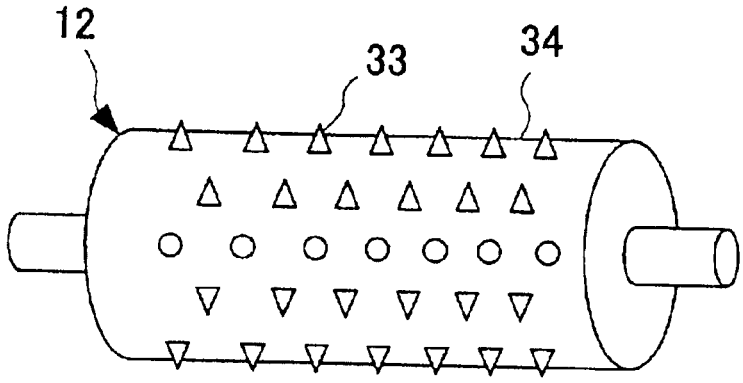
FIG. 11 is a perspective view of a grip roller.
Figure 12:
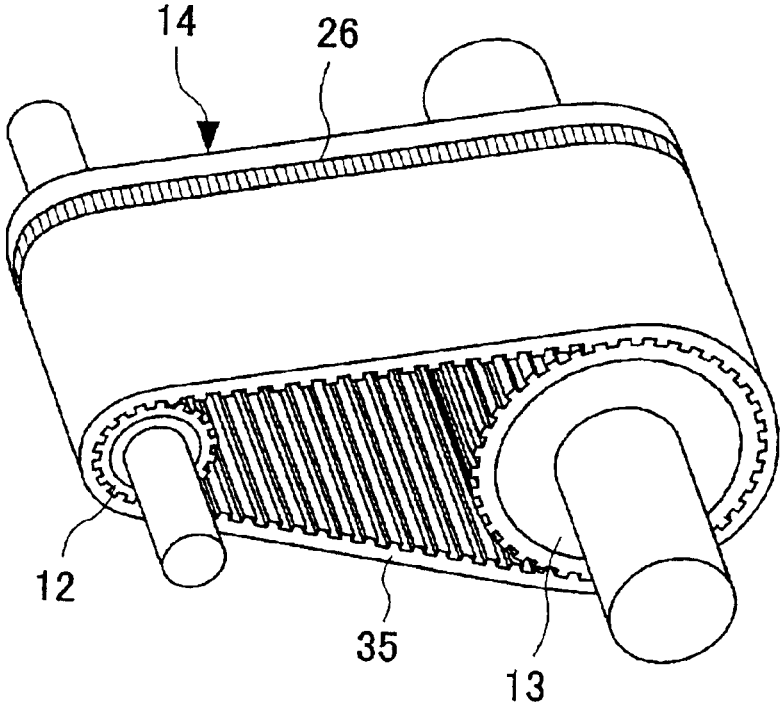
FIG. 12 is a perspective view of a timing belt formed at the inner side of the conveying belt.

Further, as shown in a perspective view of FIG. 11, the driving roller 12 or the driven roller 13 may be formed as a grip roller 34 having a plurality of projections 33. Also as shown in a perspective view of FIG. 12, a timing belt 35 may be formed throughout the inner side of the conveying belt 14 not contacting the recording sheet 17. By these arrangements, the conveying belt 14 is surely prevented from slipping on the driving roller 12 or the driven roller 13 so that the recording sheet 17 can be controlled to stop at a precise position in the course of forming an image thereon. Alternatively, the timing belt 35 may be formed at a part of the inner side of the conveying belt 14 not contacting the recording sheet 17. This arrangement prevents the conveying belt 14 from moving sideways so that the conveying belt 14 is revolved stably.

[Embodiment 5]

Figure 13:
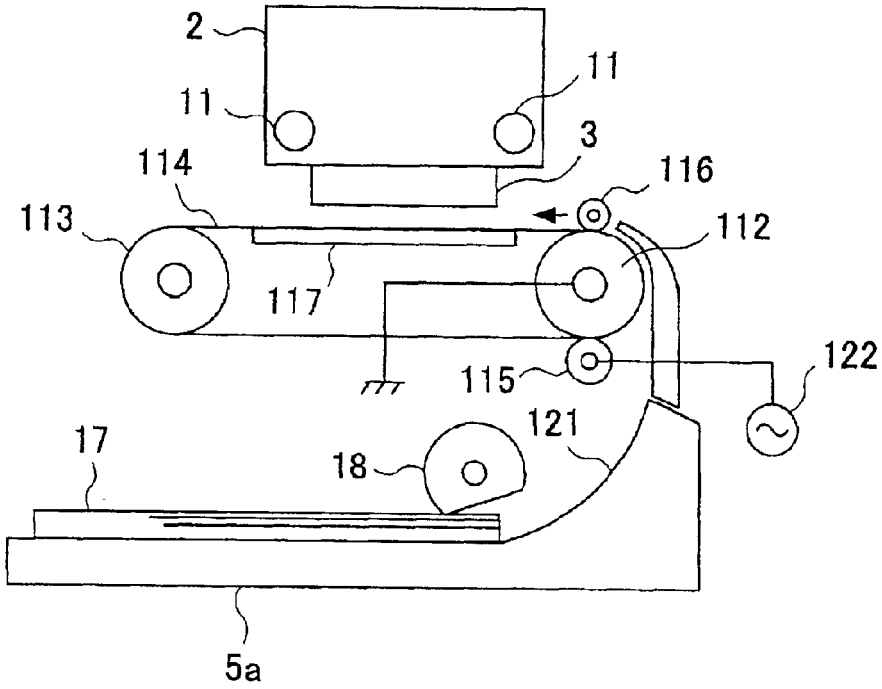
FIG. 13 is an illustration of a configuration of a recording-sheet conveying device according to a fifth embodiment of the present invention.
Figure 14A:
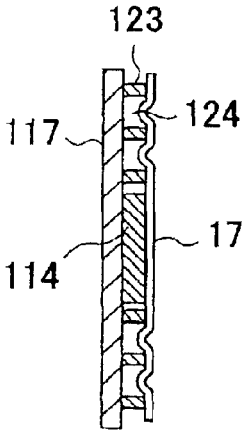
FIG. 14A and FIG. 14B are a sectional view and a top view including a conveying belt and a conveyance guide shown in FIG. 13.
Figure 14B:
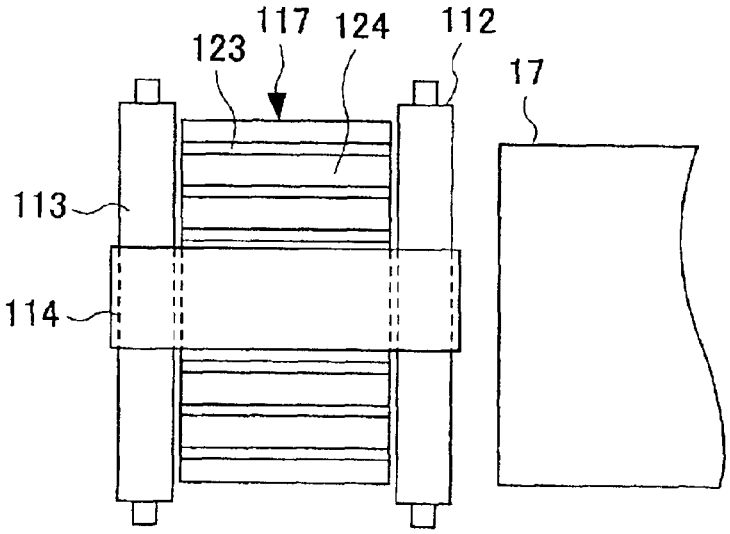

FIG. 13 is an illustration of a configuration of a recording-sheet conveying device according to a fifth embodiment of the present invention. As shown in FIG. 13, a recording-sheet conveying device 108 comprises a conveying belt 114, a belt charging roller (a belt charging unit) 115, a pressing roller 116, and a conveyance guide 117. The conveying belt 114 is wound around a driving roller 112 and a driven roller 113, and is capable of moving back and forth. The driving roller 112 is connected to a ground. A surface of the conveying belt 114 contacting the belt charging roller 115 is formed of an insulating layer. As shown in a sectional view of FIG. 14A and a top view of FIG. 14B, the conveying belt 114 is narrower than the recording sheet 17, and is wound around central parts of the driving roller 112 and the driven roller 113. The belt charging roller 115 is arranged opposite the driving roller 112 at a position upstream in a revolving direction of the driving roller 112, i.e., upstream from a position at which the recording sheet 17 separated and fed by the separating unit 18 of the feeding tray 5*a* along a guide portion 121 contacts the conveying belt 114 wound around the driving roller 112. The belt charging roller 115 is connected to an AC bias applying unit 122 applying an AC bias of, for example, 2 kV to 3 kV. The pressing roller 116 is composed of an insulating material, and is arranged opposite the driving roller 112 at a position downstream in the revolving direction of the driving roller 112 from the belt charging roller 115 and upstream in the conveying direction of the recording sheet 17 from the recording heads 3. The pressing roller 116 presses the recording sheet 17 against the conveying belt 114 by exerting an elastic force of an elastic material such as a spring. The conveyance guide 117 is arranged between the driving roller 112 and the driven roller 113 along the conveying belt 114 opposite the recording heads 3 across the conveying belt 114. As shown in FIG. 14A and FIG. 14B, the conveyance guide 117 has a plurality of ribs 123 and recession grooves 124 alternately arranged at both sides of the conveying belt 114 in a widthwise direction thereof. Each of the ribs 123 and the recession grooves 124 is aligned along the conveying direction of the recording sheet 17.

Figure 15:
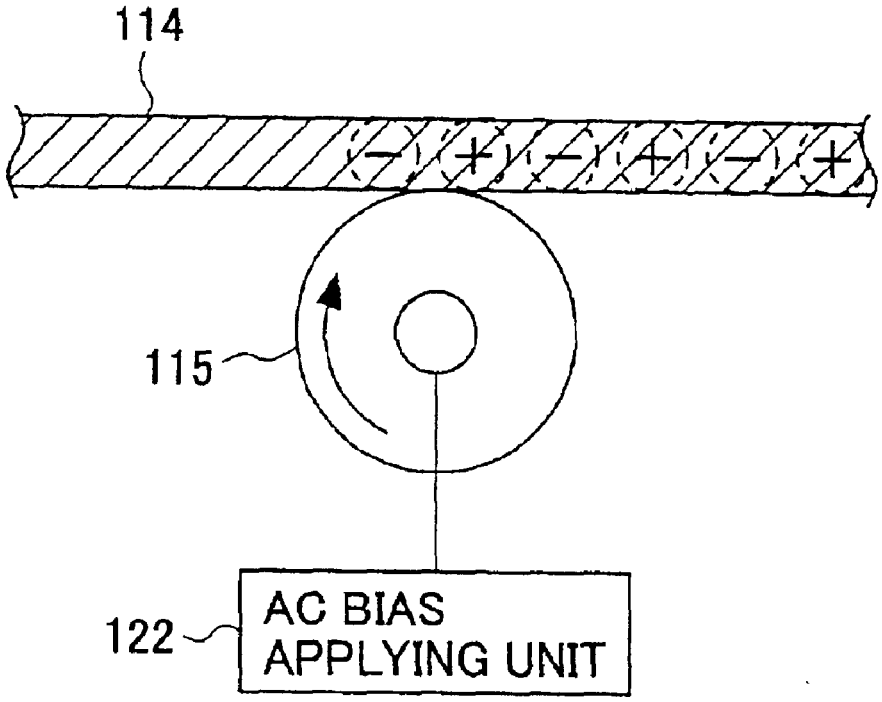
FIG. 15 is an illustration of electric charges charged in the conveying belt by applying an AC bias.
Figure 16:
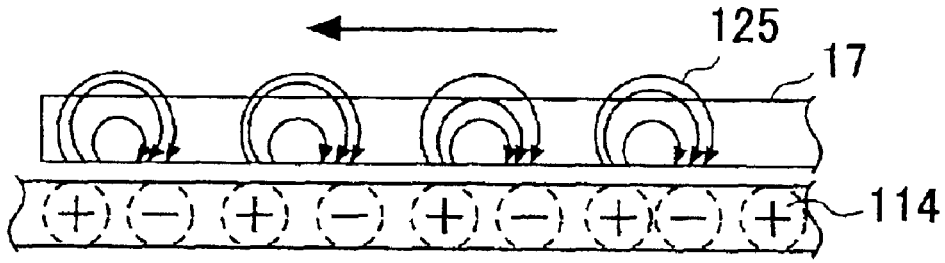
FIG. 16 is an illustration of micro electric fields generated by the electric charges charged in the conveying belt.

Upon feeding the recording sheet 17 when the inkjet printer 1 including the above-described recording-sheet conveying device 108 receives an instruction for outputting an image, the driving roller 112 is revolved by a driving motor (not shown in the figures) so that the conveying belt 114 is revolved counterclockwise. At the same time, the AC bias is applied from the AC bias applying unit 122 to the belt charging roller 115. When the AC bias is applied to the belt charging roller 115, the insulating layer of the conveying belt 114 flanked by the belt charging roller 115 and the driving roller 112 connected to the ground is charged with positive charges and negative charges alternately in a moving direction of the conveying belt 114, as shown in FIG. 15. When the recording sheet 17 separated and fed by the separating unit 18 contacts the conveying belt 114, the recording sheet 17 is subjected to electrostatic forces originating from micro electric fields 125 each induced from the positive charge to the negative charge charged in the conveying belt 114, as shown in FIG. 16. These electrostatic forces cause a central part of the recording sheet 17 to stick fast to the conveying belt 114. Therefor, the belt charging roller 115 charging the conveying belt 114 positively and negatively is arranged opposite the driving roller 112 connected to the ground; thereby, the micro electric fields 125 are surely generated. Additionally, since the belt charging roller 115 charging the conveying belt 114 positively and negatively is arranged at the position upstream in the conveying direction of the recording sheet 17 from the position at which the recording sheet 17 contacts the conveying belt 114 wound around the driving roller 112, the recording sheet 17 is stably stuck fast to the conveying belt 114.

The recording sheet 17 stuck fast to the conveying belt 114 is further pressed closely to the conveying belt 114 by the pressing roller 116. Since the pressing roller 116 is composed of an insulating material, the recording sheet 17 can be stuck to the conveying belt 114 while the positive charges and the negative charges charged in the conveying belt 114 are kept intact. The recording sheet 17 in this state is conveyed to the printing part 7 as the conveying belt 114 revolves. Then, when the image formation area at the leading part of the recording sheet 17 reaches a position right under the recording heads 3, the driving roller 112 is stopped revolving so that the conveying belt 114 is stopped revolving. In this state where the recording sheet 17 is stopped, ink drops are jetted from the recording heads 3 while the recording heads 3 are moved back and forth in scanning directions by the carriage 4 so as to form an image on the recording sheet 17. Then, when this image formation for the image formation area at the leading part of the recording sheet 17 is completed, the driving roller 112 is restarted so as to revolve the conveying belt 114. The recording sheet 17 is conveyed until the following image formation area of the recording sheet 17 reaches the position right under the recording heads 3. Thereupon, the driving roller 112 is stopped revolving so as to stop the conveying belt 114. In this state, an image is formed on the following image formation area of the recording sheet 17. Thus, the conveying belt 114 repeats the conveyance and stoppage of the recording sheet 17 so as to form an image on the recording sheet 17.

While the conveyance and stoppage of the recording sheet 17 is repeated so as to form an image on the recording sheet 17, the recording sheet 17 is stuck fast to the conveying belt 114 by the electrostatic forces originating from the micro electric fields 125. Furthermore, the conveying belt 114 and the recording sheet 17 are constantly pressed against the driving roller 112 by the pressing roller 116 so as to increase a frictional force between the driving roller 112 and the conveying belt 114 to prevent the conveying belt 114 from slipping on the driving roller 112. Accordingly, the recording sheet 17 can be conveyed and stopped with precision. Additionally, the recording sheet 17 is stuck fast to the conveying belt 114 by the electrostatic forces originating from the micro electric fields 125 discontinuously generated by the positive charges and the negative charges charged alternately in the conveying belt 114 at a constant interval of 4 mm, for example. This eliminates influences of the electrostatic forces otherwise posed on the ink drops jetted from the recording heads 3 so that the ink drops are jetted onto predetermined landing spots. Thereby, a high-quality image without positional displacement can be stably formed on the recording sheet 17.

While the ink drops are jetted from the recording heads 3 onto the recording sheet 17 so as to form an image thereon, the ink drops permeate the recording sheet 17 so that the recording sheet 17 is elongated, causing a cockling in the recording sheet 17. However, this elongated recording sheet 17 is kept at its original height by the ribs 123 of the conveyance guide 117 whereas other parts of the elongated recording sheet 17 sags into the recession grooves 124 where the ribs 123 do not exist, as shown in FIG. 14A. This prevents an elevation of the recording sheet 17 soaking the ink drops. Accordingly, this prevents influences of the cockling from displacing the landing spots of the ink drops on the recording sheet 17. This also prevents the recording sheet 17 from contacting the nozzles of the recording heads 3; thereby, the nozzles of the recording heads 3 are prevented from becoming dirty, and the recording sheet 17 is prevented from being smeared. Accordingly, a high-quality image can be stably formed on the recording sheet 17.

This recording sheet 17 on which an image is formed as described above is conveyed downstream from the recording heads 3 by the conveying belt 114. When the conveying belt 114 changes its direction around the driven roller 113, the recording sheet 17 is separated from the conveying belt 114 by its own rigidity toward the delivery roller 10. In this course, the recording sheet 17 can be easily separated from the conveying belt 114 without a need for a complicated recording-sheet separation mechanism, because the recording sheet 17 is stuck to the conveying belt 114 only by the electrostatic forces originating from the micro electric fields 125 discontinuously generated by the positive charges and the negative charges charged alternately in the conveying belt 114 at a constant interval. In addition, since only the discontinuously generated micro electric fields 125 are applied to the recording sheet 17, the electrostatic forces are prevented from remaining in the delivered recording sheet 17.

In the above-described fifth embodiment, the AC bias is applied to the belt charging roller 115, even when the conveying belt 114 is stopped while ink drops are jetted from the recording heads 3 being moved back and forth in scanning directions by the carriage 4 so as to form an image on the recording sheet 17. However, the application of the AC bias to the belt charging roller 115 may be stopped, when the conveying belt 114 is stopped. Thereby, the charges charged at a part of the conveying belt 114 contacting the belt charging roller 115 are prevented from being removed by the AC bias; therefore, when the conveying belt 114 is revolved subsequently, the recording sheet 17 is stably stuck fast to the conveying belt 114.

Additionally, in the above-described fifth embodiment, the AC bias is applied to the belt charging roller 115 upon feeding the recording sheet 17 when the inkjet printer 1 receives an instruction for outputting an image. However, when the inkjet printer 1 receives the instruction for outputting an image, the AC bias may be applied to the belt charging roller 115 beforehand while continuously revolving the conveying belt 114 so as to charge the conveying belt 114 with the positive charges and the negative charges, and then the recording sheet 17 may be fed after stopping the application of the AC bias to the belt charging roller 115 in the state where the entire conveying belt 114 is charged with the positive charges and the negative charges. Thus, charging the conveying belt 114 with the positive charges and the negative charges while continuously revolving the conveying belt 114 enables the conveying belt 114 to be charged stably.

[Embodiment 6]

Figure 17:
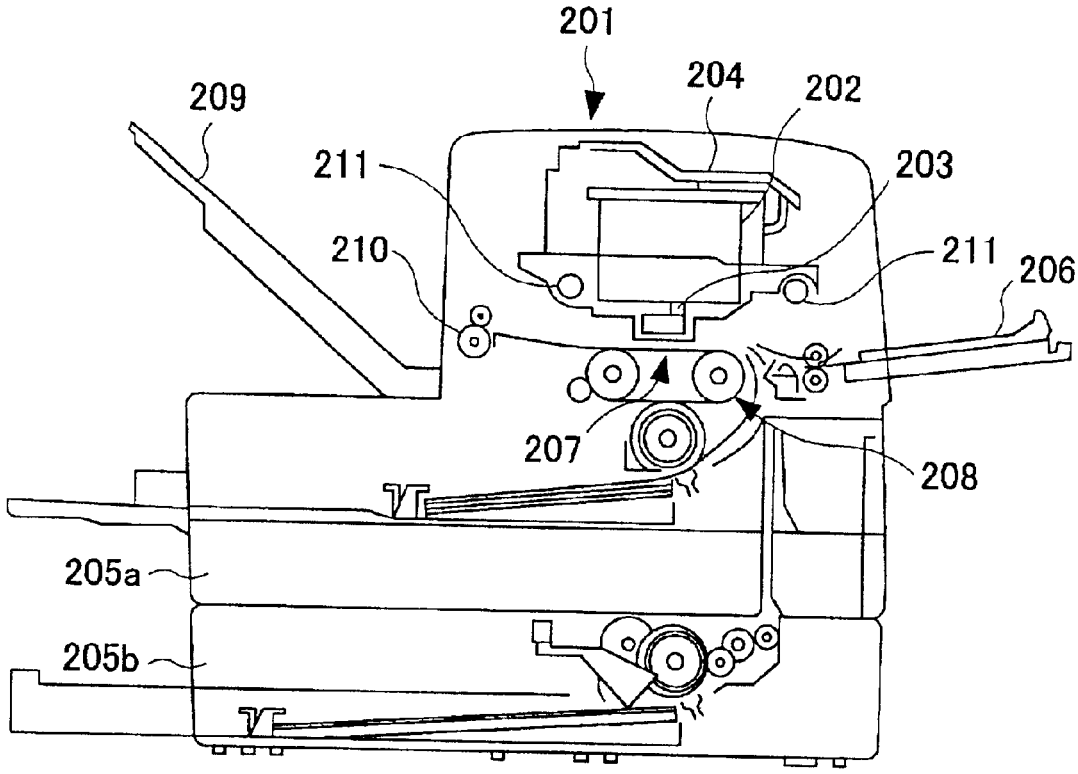
FIG. 17 is an illustration of a configuration of an inkjet printer according to a six embodiment of the present invention.

FIG. 17 is an illustration of a configuration of an inkjet printer according to a six embodiment of the present invention. As shown in FIG. 17, an inkjet printer 201 of a serial type comprises four ink cartridges 202, a recording head 203, a carriage 204, feeding trays 205*a* and 205*b*, a manual feeding tray 206, a recording-sheet conveying device 208, a delivery tray 209, and a delivery roller 210. The four ink cartridges 202 contain four inks of cyan C, magenta M, yellow Y, and black Bk, respectively. The recording head 203 has a plurality of nozzles, and are supplied with the inks from the four ink cartridges 202, respectively. The ink cartridges 202 and the recording head 203 are mounted on the carriage 204. The feeding trays 205*a* and 205*b* contain recording sheets. The feeding trays 205*a* and 205*b* and the manual feeding tray 206 form a recording-medium feeding device. The recording-sheet conveying device 208 conveys a recording sheet from the feeding trays 205*a*, 205*b*, or the manual feeding tray 206 to a printing part (an image recording part) 207 including the recording head 203. The delivery roller 210 delivers a printed recording sheet to the delivery tray 209. Upon printing image data transmitted from a host device on the recording sheet, ink drops are jetted from the nozzles of the recording head 203 on the recording sheet according to the image data so as to record a character or an image, while the carriage 204 performs a scanning guided by carriage guide rollers 211. In this course, the recording sheet is conveyed to the printing part 207 by the recording-sheet conveying device 208.

Figure 18:
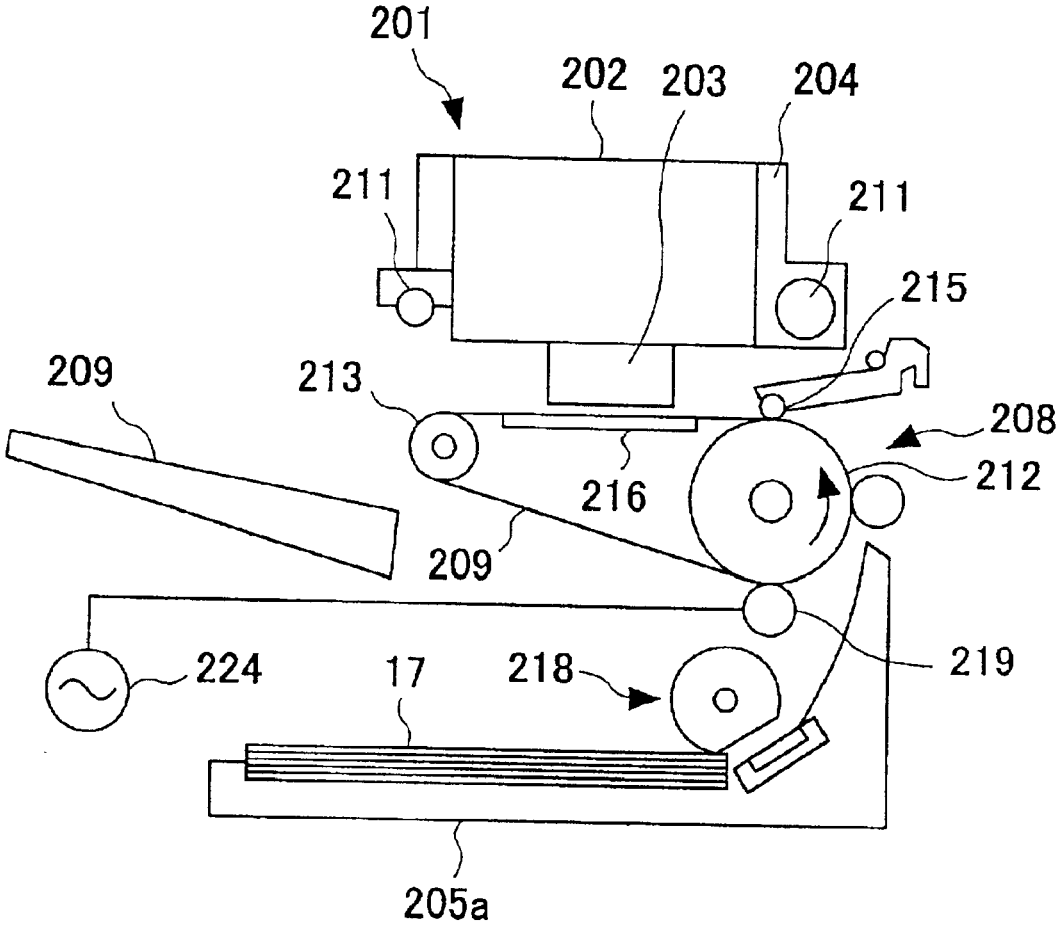
FIG. 18 is an illustration of a configuration of a recording-sheet conveying device shown in FIG. 17.

As shown in FIG. 18, the recording-sheet conveying device 208 comprises a conveying belt 214, a pressing roller 215, conveyance guides 216, and a belt charging roller (a belt charging unit) 219. The conveying belt 214 is wound around a driving roller 212 and a driven roller 213, and is capable of moving back and forth. The pressing roller 215 is pressed against a part of the conveying belt 214 wound around the driving roller 212 by an elastic force of an elastic material such as a spring so as to prevent the conveying belt 214 from slipping on the driving roller 212. The conveyance guides 216 are arranged between the driving roller 212 and the driven roller 213 along a stretch nearer to the recording head 203. The belt charging roller 219 is arranged opposite the driving roller 212, and contacts the conveying belt 214 at a position upstream in a revolving direction of the driving roller 212, i.e., upstream from a position at which the recording sheet 17 separated and fed from the feeding tray 205*a* by a separating unit 218 contacts the conveying belt 214 wound around the driving roller 212. The driving roller 212 is connected to a ground.

Figure 19A:
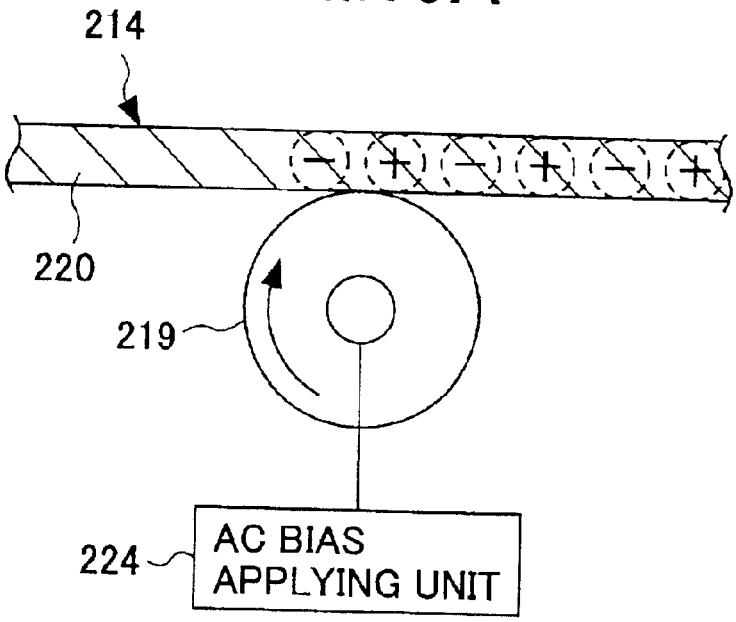
FIG. 19A is a cross-sectional view of a one-layer structure of a conveying belt shown in FIG. 18.
Figure 19B:
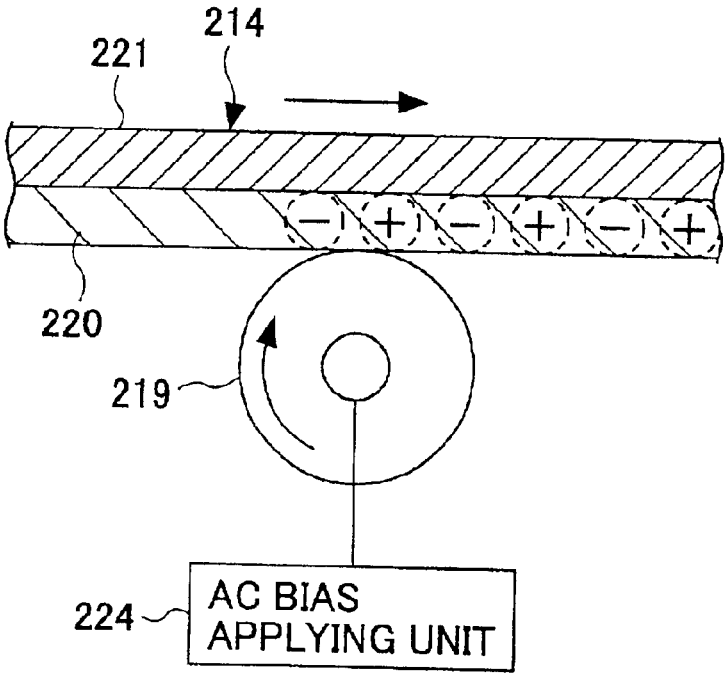
FIG. 19B is a cross-sectional view of a two-layer structure of the conveying belt shown in FIG. 18.

The conveying belt 214 has a one-layer structure, as shown in FIG. 19A, or has a two-layer structure, as shown in FIG. 19B. An insulating layer 220 is formed at the outer side of the two-layer structure contacting the recording sheet 17 and the belt charging roller 219. When the conveying belt 214 has the two-layer structure, a conductive layer 221 is formed at the inner side of the two-layer structure not contacting the recording sheet 17 or the belt charging roller 219. The insulating layer 220 is formed of a resin or an elastomer, such as PET, PEI, PVDF, PC, ETFE, or PTFE, not containing a conductive control material so as to have a volume resistivity of $10^{12}$ Ωcm or more, preferably $10^{15}$ Ωcm. The conductive layer 221 is formed of the above-mentioned resin or the elastomer containing a carbon so as to have a volume resistivity of $10^5$ to $10^7$ Ωcm.

Figure 20A:
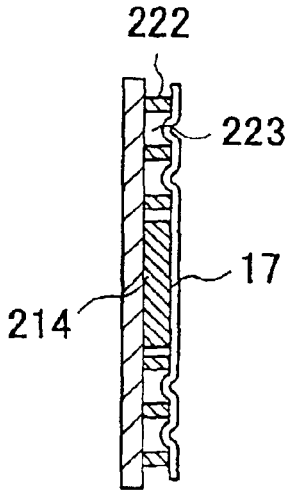
FIG. 20A and FIG. 20B are a sectional view and a top view including the conveying belt and conveyance guides shown in FIG. 18.
Figure 20B:
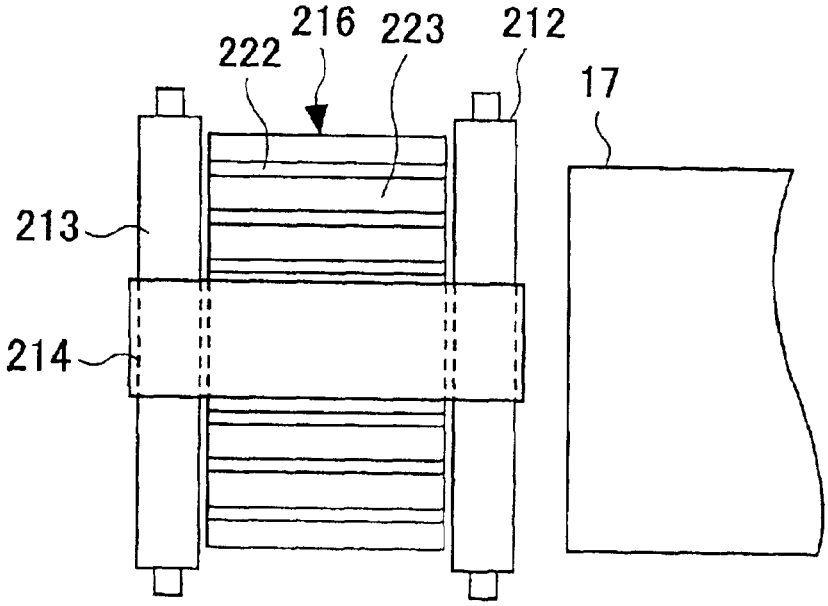

As shown in a sectional view of FIG. 20A and a top view of FIG. 20B, the conveying belt 214 is narrower than the recording sheet 17, and is wound around central parts of the driving roller 212 and the driven roller 213. The conveyance guides 216 are arranged at both sides of the conveying belt 214 in a widthwise direction thereof, and have a plurality of ribs 222 and recession grooves 223 arranged alternately. Each of the ribs 222 and the recession grooves 223 is aligned along a direction (a conveying direction of the recording sheet 17) in which the recording sheet 17 is conveyed. As shown in FIG. 19A and FIG. 19B, the belt charging roller 219 is connected to an AC bias applying unit 224 applying an AC bias of, for example, 2 kV to 3 kV.

When the inkjet printer 201 of the serial type receives an instruction for outputting an image, the driving roller 212 of the recording-sheet conveying device 208 is revolved by a driving motor (not shown in the figures) so that the conveying belt 214 is revolved counterclockwise. At the same time, the AC bias is applied from the AC bias applying unit 224 to the belt charging roller 219. By this AC bias applied to the belt charging roller 219, the insulating layer 220 of the conveying belt 214 is charged with positive charges and negative charges alternately in a direction (a moving direction of the conveying belt 214) in which the conveying belt 214 moves, as shown in FIG. 19A and FIG. 19B. Since this insulating layer 220 of the conveying belt 214 charged with the positive charges and the negative charges is so formed as to have the volume resistivity of $10^{12}$ Ωcm or more, preferably $10^{15}$ Ωcm, the positive charges and the negative charges alternately charged in the insulating layer 220 are prevented from moving across boundaries therebetween so that the insulating layer 220 can be charged stably with the positive charges and the negative charges alternately.

Figure 21A:
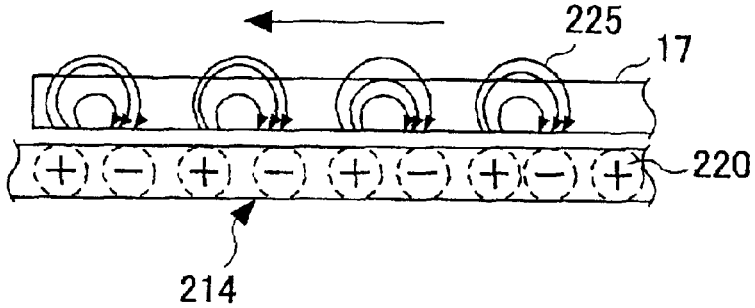
FIG. 21A is an illustration of micro electric fields generated by electric charges charged in the conveying belt shown in FIG. 19A.
Figure 21B:
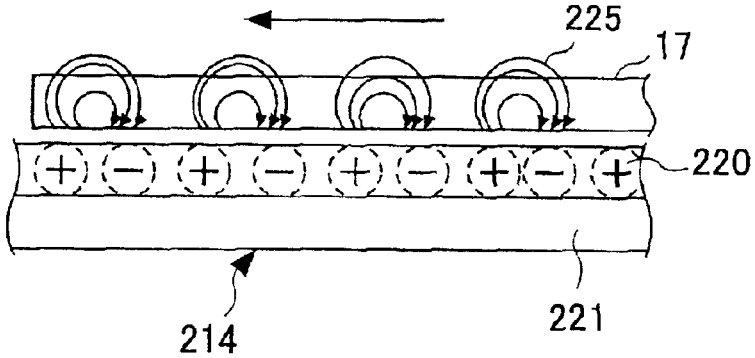
FIG. 21B is an illustration of micro electric fields generated by electric charges charged in the conveying belt shown in FIG. 19B.

When the recording sheet 17 separated and fed by the separating unit 218 contacts the conveying belt 214, the recording sheet 17 is subjected to electrostatic forces originating from micro electric fields 225 each induced from the positive charge to the negative charge charged in the insulating layer 220 of the conveying belt 214, as shown in FIG. 21A and FIG. 21B. These electrostatic forces cause a central part of the recording sheet 17 to stick fast to the conveying belt 214. Therefor, the belt charging roller 219 charging the conveying belt 214 positively and negatively is arranged at the position upstream in the revolving direction of the driving roller 212 in the vicinity of the position at which the recording sheet 17 fed by the separating unit 218 contacts the conveying belt 214; thereby, the micro electric fields 25 are surely generated at the position at which the recording sheet 17 contacts the conveying belt 214 so that the recording sheet 17 is stably stuck fast to the conveying belt 214. Additionally, the recording sheet 17 can be conveyed while the evenness of a print surface thereof is maintained without being pressed by a spur, etc. Therefore, not only a high-quality image can be stably formed on the recording sheet 17, but also the print surface of the recording medium can be prevented from being smeared or damaged.

The recording sheet 17 stuck fast to the conveying belt 214 is conveyed to the printing part 207 by the revolution of the conveying belt 214 while the recording sheet 17 is pressed by the pressing roller 215. Then, when the image formation area at the leading part of the recording sheet 17 reaches a position right under the recording head 203, the driving roller 212 is stopped revolving so that the conveying belt 214 is stopped revolving. In this state where the recording sheet 17 is stopped, ink drops are jetted from the recording head 203 while the recording head 203 are moved back and forth in scanning directions by the carriage 204 so as to form an image on the recording sheet 17. Then, when this image formation for the image formation area at the leading part of the recording sheet 17 is completed, the driving roller 212 is restarted so as to revolve the conveying belt 214. The recording sheet 17 is conveyed until the following image formation area of the recording sheet 17 reaches the position right under the recording head 203. Thereupon, the driving roller 212 is stopped revolving so as to stop the conveying belt 214. In this state, an image is formed on the following image formation area of the recording sheet 17. Thus, the conveying belt 214 repeats the conveyance and stoppage of the recording sheet 17 so as to form an image on the recording sheet 17.

While the conveyance and stoppage of the recording sheet 17 is repeated so as to form an image on the recording sheet 17, the recording sheet 17 is stuck fast to the conveying belt 214 by the electrostatic forces originating from the micro electric fields 225. Additionally, since the recording sheet 17 stuck fast electrostatically to the conveying belt 214 is constantly pressed against the conveying belt 214 by the pressing roller 215, the recording sheet 17 adheres closely to the conveying belt 214 so that the recording sheet 17 can be conveyed stably to the position right under the recording head 203. Also, the conveying belt 214 is constantly pressed against the driving roller 212 by the pressing roller 215 so as to increase a frictional force between the driving roller 212 and the conveying belt 214 to prevent the conveying belt 214 from slipping on the driving roller 212. Accordingly, the recording sheet 17 can be conveyed and stopped with precision. Additionally, the recording sheet 17 is stuck fast to the conveying belt 214 by the electrostatic forces originating from the micro electric fields 225 discontinuously generated by the positive charges and the negative charges charged alternately in the conveying belt 214 at a constant interval of 4 mm, for example. This prevents influences of the electrostatic forces from being posed on the ink drops jetted from the recording head 203 so that the ink drops are jetted onto predetermined landing spots. Thereby, a high-quality image without positional displacement can be stably formed on the recording sheet 17.

While the ink drops are jetted from the recording head 203 onto the recording sheet 17 so as to form an image thereon, the ink drops permeate the recording sheet 17 so that the recording sheet 17 is elongated, causing a cockling in the recording sheet 17. However, this elongated recording sheet 17 is kept at its original height by the ribs 222 of the conveyance guides 216 whereas other parts of the elongated recording sheet 17 sags into the recession grooves 223 where the ribs 222 do not exist, as shown in FIG. 20A. This prevents an elevation of the recording sheet 17 soaking the ink drops, without pressing a print surface of the recording sheet 17. Accordingly, this prevents influences of the cockling from displacing the landing spots of the ink drops on the recording sheet 17. This also prevents the recording sheet 17 from contacting the nozzles of the recording head 203; thereby, the nozzles of the recording head 203 are prevented from becoming dirty, and the recording sheet 17 is prevented from being smeared. Accordingly, a high-quality image can be stably formed on the recording sheet 17.

This recording sheet 17 on which an image is formed as described above is conveyed downstream from the recording head 203 by the conveying belt 214. When the conveying belt 214 changes its direction around the driven roller 213, the recording sheet 17 is separated from the conveying belt 214 by its own rigidity toward the delivery roller 210. In this course, the recording sheet 17 can be easily separated from the conveying belt 214 without a need for providing a complicated recording-sheet separation mechanism, because the recording sheet 17 is stuck to the conveying belt 214 only by the electrostatic forces originating from the micro electric fields 225 discontinuously generated by the positive charges and the negative charges charged alternately in the conveying belt 214 at a constant interval. In addition, since only the discontinuously generated micro electric fields 225 are applied to the recording sheet 17, the electrostatic forces are prevented from remaining in the delivered recording sheet 17. Further, when the conveying belt 214 has the two-layer structure of the insulating layer 220 and the conductive layer 221, the positive charges and the negative charges charged in the insulating layer 220 are discharged to some extent while the conveying belt 214 moves from the position right under the recording head 203 to the driven roller 213. Therefore, the recording sheet 17 can be easily separated from the conveying belt 214.

In the above-described sixth embodiment, the AC bias is applied to the belt charging roller 219, even when the conveying belt 214 is stopped while ink drops are jetted from the recording head 203 being moved back and forth in scanning directions by the carriage 204 so as to form an image on the recording sheet 17. However, the application of the AC bias to the belt charging roller 219 may be stopped, when the conveying belt 214 is stopped. This function prevents the AC bias from removing the charges charged at a part of the conveying belt 214 contacting the belt charging roller 219, and also prevents charges from being charged in unintended directions; therefore, when the conveying belt 214 is revolved subsequently, the recording sheet 17 is stably stuck fast to the conveying belt 214. Besides, although only a slight electric current flows in the charged conveying belt 214, there is a risk of heat being generated in the conveying belt 214 so as to induce a pin hole which may result in a leak, when one particular part of the conveying belt 214 is continuously charged. However, the above-mentioned function of stopping the application of the AC bias prevents the conveying belt 214 from being damaged.

Additionally, in the above-described sixth embodiment, the pressing roller 215 is composed of an insulating material, and the AC bias is applied to the belt charging roller 219 upon feeding the recording sheet 17 when the inkjet printer 201 receives an instruction for outputting an image. However, when the inkjet printer 201 receives the instruction for outputting an image, the AC bias may be applied to the belt charging roller 219 beforehand while continuously revolving the conveying belt 214 so as to charge the conveying belt 214 with the positive charges and the negative charges, and then the recording sheet 17 may be fed after stopping the application of the AC bias to the belt charging roller 219 in the state where the entire conveying belt 214 is charged with the positive charges and the negative charges. Thus, charging the conveying belt 214 with the positive charges and the negative charges while continuously revolving the conveying belt 214 enables the conveying belt 214 to be stably charged with the positive charges and the negative charges.

When the conveying belt 214 of the inkjet printer 201 of the serial type conveys the recording sheet 17 to the position right under the recording head 203, and intermittently repeats the revolution and stoppage thereof, the conveying belt 214 needs to be controlled to stop at a precise position so as to stabilize a precision of starting a new print line on the recording sheet 17. Therefor, a feed speed (a conveyance speed) or a feed distance (a conveyance distance) of the conveying belt 214 is directly or indirectly detected so that a conveyance distance of the conveying belt 214 is controlled according to the detected feed speed or the feed distance.

Figure 22A:
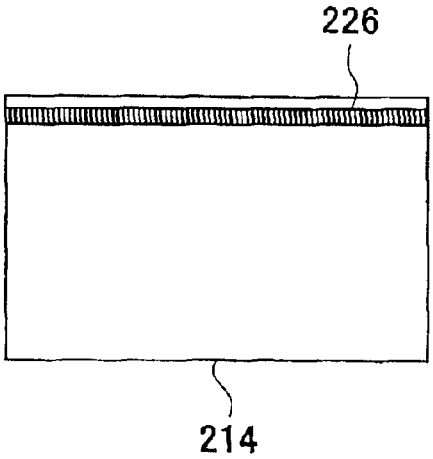
FIG. 22A is a magnified view of a binary scale formed on the conveying belt.
Figure 22B:
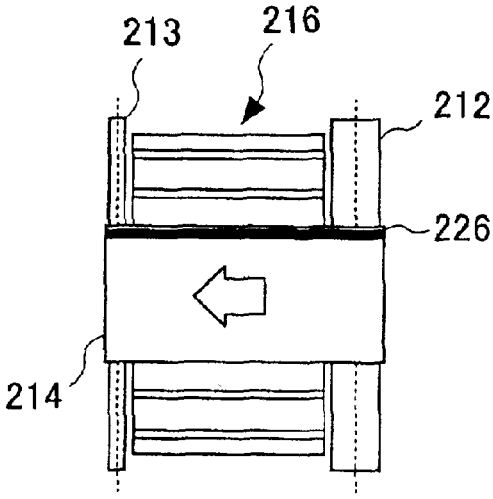
FIG. 22B is a front view of the binary scale formed on the conveying belt.
Figure 23A:
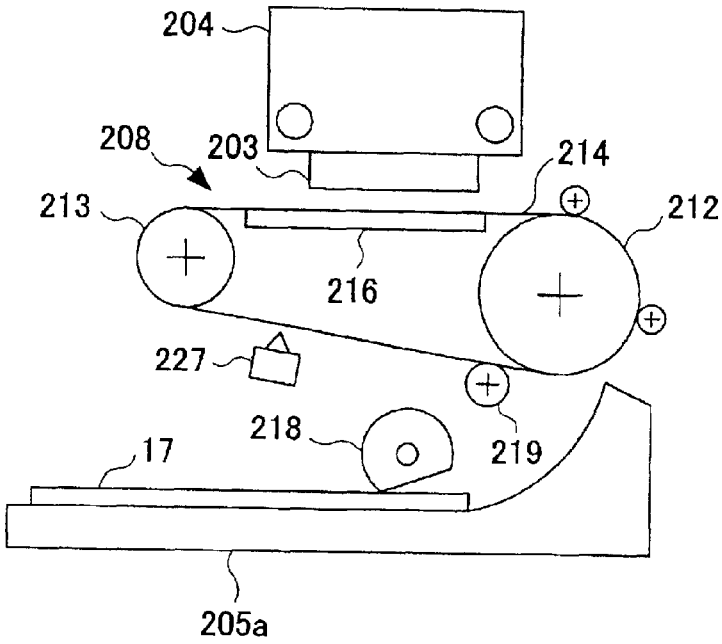
FIG. 23A and FIG. 23B are illustrations showing arrangements of a read sensor.
Figure 23B:
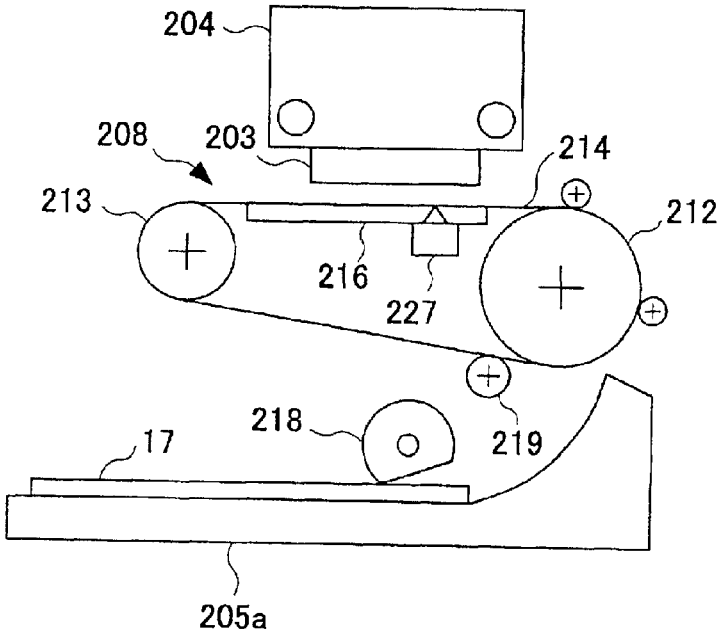
Figure 24:
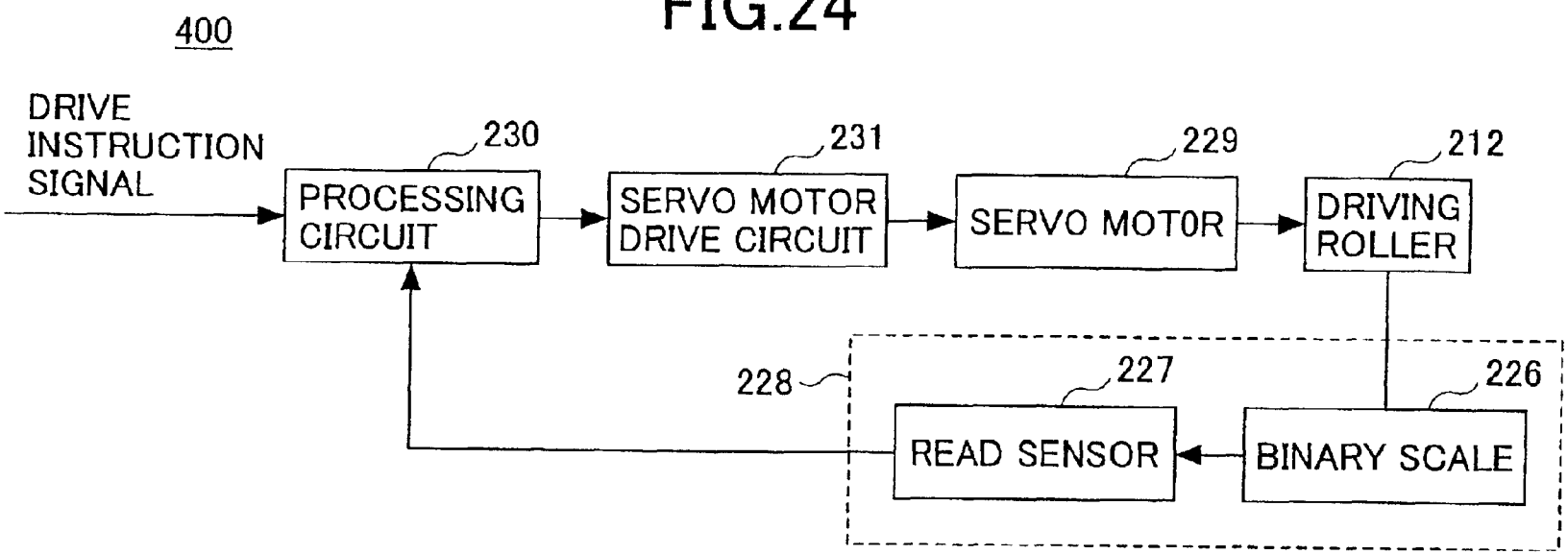
FIG. 24 is a block diagram of a drive control unit for controlling a driving roller shown in FIG. 18.

For example, in order that the feed speed or the feed distance of the conveying belt 214 is directly detected, an encoder (a conveyance distance detecting unit) 228 including a binary scale 226 and a read sensor 227 shown in a block diagram of FIG. 24 may be used. The binary scale 226 has pitches formed on a part of the outer surface or the inner surface of the conveying belt 214 at an interval in accordance with a maximum resolution of the inkjet printer 201, as shown in a magnified view (FIG. 22A) and a front view (FIG. 22B) of the conveying belt 214. The read sensor 227 is of a transmission type or a reflection type provided at a part that does not influence the conveyance of the recording sheet 17 by the conveying belt 214, as shown in FIG. 23A, or of a transmission type provided in the vicinity of the printing part 207, as shown in FIG. 23B. In a drive control unit (a conveyance control device) 400 shown in FIG. 24, a processing circuit 230 receives a drive instruction signal, and computes a revolving velocity of a servomotor (a conveying-belt driving unit) 229 revolving the driving roller 212. In this course, a pulse signal is transmitted from the read sensor 227 to the processing circuit 230 so that the processing circuit 230 calculates the feed speed of the conveying belt 214. Then, a feed-speed signal representing the calculated feed speed is transmitted from the processing circuit 230 to a servomotor drive circuit 231 driving the servomotor 229 so as to control the revolving velocity of the servomotor 229 at a constant velocity. Thus, the driving roller 212 is revolved. As described above, by controlling the revolving velocity of the servomotor 229 revolving the driving roller 212, the conveyance distance of the recording sheet 17 can be controlled with precision.

The interval between the pitches of the binary scale 226 of the encoder 228 formed on the conveying belt 214 is a unit of precision of feeding the recording sheet 17. Additionally, a distance of feeding the recording sheet 17 to start a new print line corresponds to a minimum unit of the maximum resolution (a dot length) of the inkjet printer 201. For example, assuming that the maximum resolution of the inkjet printer 201 is 1200 dpi, a minimum unit distance of feeding the recording sheet 17 to start a new print line is determined according to the maximum resolution, as 25.4 mm/1200=21.2 $\mu$m. Thereupon, the interval between the pitches of the binary scale 226, i.e., a unit distance for controlling the feed distance, is made as 21.2 $\mu$m/n, where n is an integer larger than zero. For example, assuming that n is 2, the interval between the pitches of the binary scale 226 becomes 10.6 $\mu$m. Accordingly, when the feed distance of the conveying belt 214 is controlled according to the pulse signal transmitted from the read sensor 227 reading the binary scale 226, a displacement by one pulse does not influence the image formed on the recording sheet 17; thus, a high-quality image can be stably formed.

On the other hand, in order that the feed speed or the feed distance of the conveying belt 214 is indirectly detected, a rotary encoder (conveyance distance detecting unit) 235 may be used so as to detect a revolving distance of the driving roller 212 and calculate the feed speed or the feed distance of the conveying belt 214. The rotary encoder 235 includes a disc 232, a scale 233 and a read sensor 234 of a transmission type or a reflection type. The disc 232 is provided on a rotary shaft of the driving roller 212 driving the conveying belt 214, as shown in FIG. 25. The scale 233 has pitches (lines) arranged on the disc 232 in a circumferential direction thereof at a constant interval, as shown in a front view of FIG. 26A and a magnified view of FIG. 26B. The read sensor 234 reads the scale 233. In general, a scale pitch P of a rotary encoder is of 100 LPI, 150 LPI, 200 LPI, 300 LPI, and so forth. A well-known rotary encoder outputs pulses four times as many as an actual scale pulse. In an instance of the scale 233 having 2400 lines per revolution, the read sensor 234 capable of the above-mentioned fourfold output can output 9600 pulses. Additionally, a distance of feeding the recording sheet 17 to start a new print line corresponds to a minimum unit of the maximum resolution (a dot length) of the inkjet printer 201. For example, assuming that the maximum resolution of the inkjet printer 201 is 600 dpi, a minimum unit of the feed distance is determined as 25.4 mm/600=42.3 $\mu$m. Actually, the recording sheet 17 is fed by an integral multiple of 42.3 $\mu$m. In the inkjet printer 201, the feed distance of the conveying belt 214 is determined according to the maximum resolution thereof.

As a more specific example, assuming that the driving roller 212 driving the conveying belt 214 is controlled according to a fourfold pulse signal output by the rotary encoder 235 comprising the scale 233 having 2400 pitches per revolution, the number of pulses per revolution output by the rotary encoder 235 is 2400×4=9600 pulses. Then, assuming that the maximum resolution of the inkjet printer 201 is 1200 dpi, a feed distance corresponding to one output pulse is 25.4 mm/1200=21.2 $\mu$m. Since one revolution of the driving roller 212 coincides with one revolution of the disc 232 having the scale 233, a diameter of the driving roller 212 is calculated to be 64.5 mm, based on the following relational expression.

$$(d\times\pi)/9600=21.2\ \mu\text{m}$$

d: diameter of the driving roller 212

That is, using the driving roller 212 having the diameter of 64.5 mm, and the rotary encoder 235 comprising the scale 233 provided on the rotary shaft of the driving roller 212 and having 2400 pitches makes the feed distance corresponding to one pulse 21.2 $\mu$m.

In stead of using the feed distance of 21.2 $\mu$m corresponding to one output pulse obtained according to the maximum resolution, it is preferred that the diameter of driving roller 212 is determined such that a feed distance corresponding to one output pulse of the rotary encoder 235 becomes a value obtained by dividing the feed distance of 21.2 $\mu$m determined according to the maximum resolution by n (n is an integer larger than one). For example, when n is 2, the diameter of the driving roller 212 is calculated to be 32.4 mm, based on the following relational expression.

$$(d\times\pi)/9600=10.6\ \mu\text{m}$$

d: diameter of the driving roller 212

That is, using the driving roller 212 having the diameter of 32.4 mm, and the rotary encoder 235 comprising the scale 233 provided on the rotary shaft of the driving roller 212 and having 2400 pitches makes the feed distance corresponding to one pulse 10.6 $\mu$m. Accordingly, a displacement by one pulse in controlling the feed distance of the driving roller 212 does not influence the image formed on the recording sheet 17; thus, a highly precise image can be stably formed.

Figure 27A:
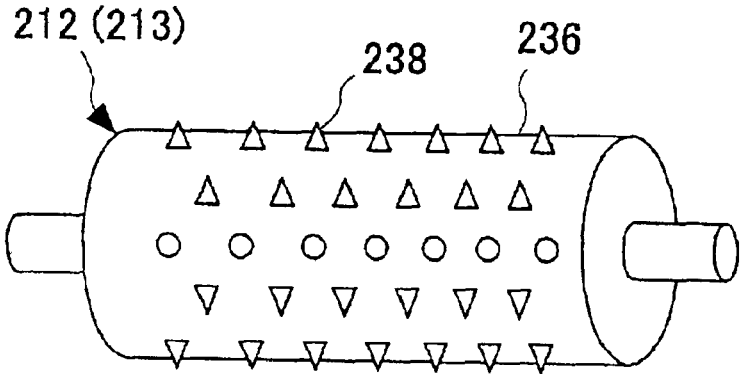
FIG. 27A and FIG. 27B are perspective views of slippage prevention mechanisms provided between the driving roller and the conveying belt.
Figure 27B:
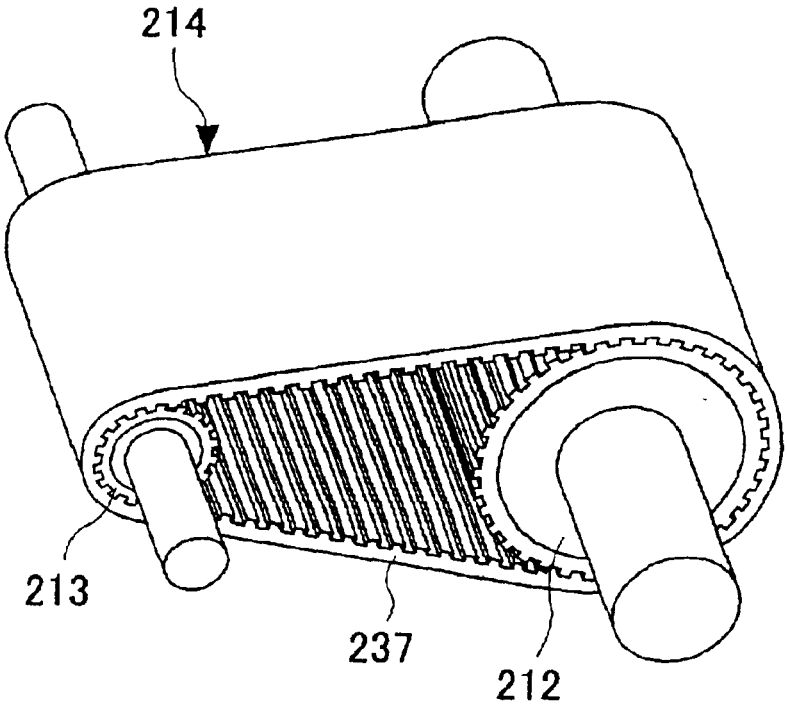

Further, a slippage prevention mechanism may be provided between the driving roller 212 and the conveying belt 214. For example, as shown in FIG. 27A, both of the driving roller 212 and the driven roller 213, or only the driving roller 212, may be formed as a grip roller 236 having a plurality of projections 238 on the surface thereof. Also as shown in FIG. 27B, the conveying belt 214 is formed by a timing belt 237. These slippage prevention mechanisms surely prevent the conveying belt 214 from slipping on the driving roller 212 or the driven roller 213 so that the recording sheet 17 can be controlled to stop at a precise position in the course of forming an image thereon, and also can be conveyed reversely with high precision.

Figure 28A:
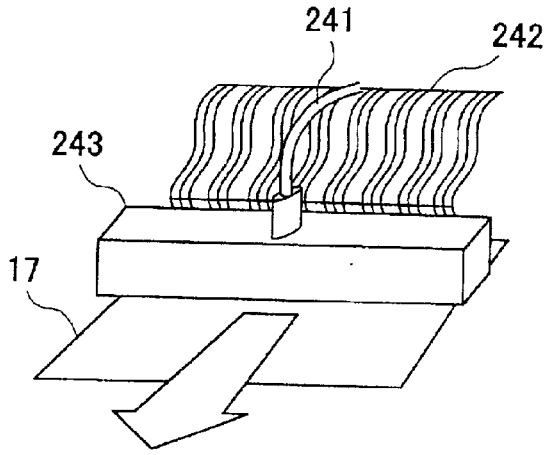
FIG. 28A is a perspective view of a configuration of a line head.
Figure 28B:
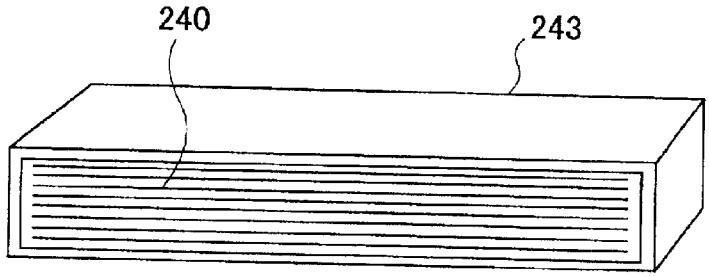
FIG. 28B is a front view of a line of nozzles of the line head shown in FIG. 28A.
Figure 29:
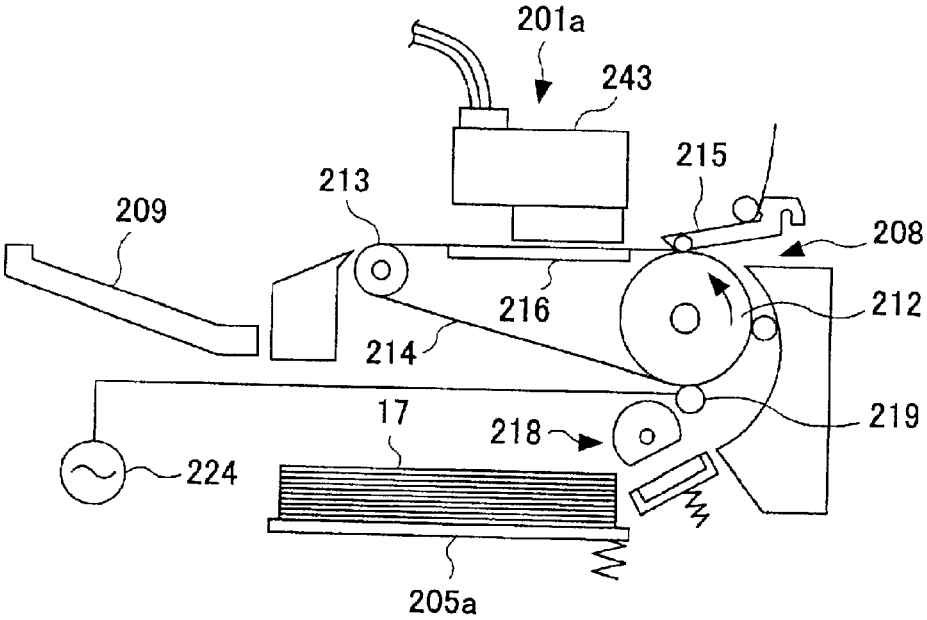
FIG. 29 is an illustration of a configuration of an inkjet printer of a line type including the line head shown in FIG. 28A.

Besides, although the above-described sixth embodiment sets forth the inkjet printer 201 of the serial type, the recording-sheet conveying device 208 is similarly applicable to an inkjet printer of a line type using a line head. As shown in a perspective view (FIG. 28A) of the line head and a front view (FIG. 28B) of a line of nozzles, a line head 243 comprises a line of nozzles 240 extending from side to side in a widthwise direction of the recording sheet 17 so as to jet inks supplied from an ink supplying tube 241 throughout a printable width of the recording sheet 17 according to a drive signal output from head drive signal lines 242. As shown in FIG. 29, the recording-sheet conveying device 208 is similarly applicable to an inkjet printer 201*a* of the line type using the line head 243 so as to convey the recording sheet 17 stuck fast electrostatically to the conveying belt 214 stably to and at the printing part 207 so that a high-quality image can be formed stably with a more precise feed speed.

The present invention is not limited to the specifically disclosed embodiments, and variations and modifications may be made without departing from the scope of the present invention.

The present application is based on Japanese priority applications No. 2001-065926 filed on Mar. 9, 2001, No. 2001-221049 filed on Jul. 23, 2001, and No. 2001-388792 filed on Dec. 21, 2001, the entire contents of which are hereby incorporated by reference.

What is claimed is:

1. A recording-medium conveying device conveying a recording medium to an image recording part, the recording medium being separated and fed from a recording-medium feeding device, the recording-medium conveying device comprising:

a conveying belt wound around a driving roller and a driven roller so as to convey said recording medium to said image recording part, the conveying belt having an insulating layer formed at at least a side contacting said recording medium; and a belt charging unit provided in contact with said conveying belt and in a vicinity of a separating unit so as to charge said conveying belt with a positive charge and a negative charge alternately in a moving direction of said conveying belt by applying an AC bias to said conveying belt, wherein a first length of a path along which the recording medium travels after being separated by the separating unit and until the recording medium contacts the conveying belt is greater than a second length along the conveying belt from a position of the belt charging unit to a position at which the recording medium contacts the conveying belt.

2. A recording-medium conveying device as claimed in claim 1, wherein the conveying belt has a two-layer structure composed of the insulating layer formed at one side contacting said recording medium and a conductive layer formed at the other side not contacting said recording medium, wherein the belt charging unit is in contact with said insulating layer in a vicinity of said separating unit so as to charge said insulating layer with a positive charge and a negative charge alternately in a moving direction of said conveying belt by applying an AC bias to said conveying belt, and wherein at least one of said driving roller and said driven roller is a grip roller having a plurality of projections.

3. The recording-medium conveying device as claimed in claim 1, wherein said belt charging unit applies said AC bias to said conveying belt while said conveying belt conveys said recording medium, and said belt charging unit stops applying said AC bias to said conveying belt while said conveying belt stops conveying said recording medium.

4. The recording-medium conveying device as claimed in claim 1, wherein said belt charging unit applies said AC bias to said conveying belt while said conveying belt is continuously revolved, before said conveying belt conveys said recording medium.

5. The recording-medium conveying device as claimed in claim 1, wherein said conveying belt is formed of one layer of said insulating layer.

6. The recording-medium conveying device as claimed in claim 1, wherein said conveying belt is formed of two layers composed of said insulating layer formed at one side contacting said recording medium and a conductive layer formed at the other side not contacting said recording medium.

7. The recording-medium conveying device as claimed in claim 1, further comprising a pressing roller pressing said conveying belt against said driving roller by exerting an elastic force so as to prevent said conveying belt from slipping on said driving roller.

8. The recording-medium conveying device as claimed in claim 7, wherein said pressing roller is provided at a position downstream in a revolving direction of said driving roller.

9. The recording-medium conveying device as claimed in claim 1, wherein at least said driving roller among said driving roller and said driven roller has a plurality of projections on a surface thereof.

10. The recording-medium conveying device as claimed in claim 1, wherein said conveying belt is formed of a timing belt.

11. A recording-medium conveying device conveying a recording medium to an image recording part, the recording medium being separated and fed from a recording-medium feeding device by a separating unit thereof, the recording-medium conveying device comprising:

a conveying belt wound around a driving roller and a driven roller so as to convey said recording medium to said image recording part, the conveying belt having a two-layer structure composed of an insulating layer formed at one side contacting said recording medium and a conductive layer formed at the other side not contacting said recording medium;

a belt charging unit provided in contact with said insulating layer in a vicinity of said separating unit so as to charge said insulating layer with a positive charge and a negative charge alternately in a moving direction of said conveying belt by applying an AC bias to said conveying belt; and a pressing roller pressing said conveying belt against said driving roller by exerting an elastic force so as to prevent said conveying belt from slipping on said driving roller, wherein a first length of a path along which the recording medium travels after being separated by the separating unit and until the recording medium contacts the conveying belt is greater than a second length along the conveying belt from a position of the belt charging unit to a position at which the recording medium contacts the conveying belt.

12. The recording-medium conveying device as claimed in claim 11, wherein a surface of said driving roller is cured.

13. The recording-medium conveying device as claimed in claim 12, wherein the surface of said driving roller is cured by being coated with urethane.

14. A recording-medium conveying device conveying a recording medium to an image recording part, the recording medium being separated and fed from a recording-medium feeding device by a separating unit thereof, the recording-medium conveying device comprising:

a conveying belt wound around a central part of a driving roller and a central part of a driven roller so as to convey said recording medium to said image recording part, the conveying belt being narrower than said recording medium, and having a two-layer structure composed of an insulating layer formed at one side contacting said recording medium and a conductive layer formed at the other side not contacting said recording medium;

conveyance guides provided at both sides of said conveying belt in a widthwise direction thereof in said image recording part, the conveyance guides having a plurality of ribs and recession grooves alternately, each of said ribs and said recession grooves being aligned along a conveying direction of said recording medium;

a belt charging unit provided in contact with said insulating layer in a vicinity of said separating unit so as to charge said insulating layer with a positive charge and a negative charge alternately in a moving direction of said conveying belt by applying an AC bias to said conveying belt; and a pressing roller pressing said conveying belt against said driving roller by exerting an elastic force so as to prevent said conveying belt from slipping on said driving roller.

15. The recording-medium conveying device as claimed in claim 14, wherein a surface of said driving roller is cured.

16. The recording-medium conveying device as claimed in claim 15, wherein the surface of said driving roller is cured by being coated with urethane.

17. The recording-medium conveying device as claimed in claim 14, wherein one of said driving roller and said driven roller positioned upstream in the conveying direction of said recording medium has a large diameter, and the other of said driving roller and said driven roller positioned downstream in the conveying direction of said recording medium has a small diameter.

18. A recording-medium conveying device conveying a recording medium to an image recording part, the recording medium being separated and fed from a recording-medium feeding device by a separating unit thereof, the recording-medium conveying device comprising:

a conveying belt wound around a central part of a driving roller and a central part of a driven roller so as to convey said recording medium to said image recording part, the conveying belt being narrower than said recording medium, and having a two-layer structure composed of an insulating layer formed at one side contacting said recording medium and a conductive layer formed at the other side not contacting said recording medium;

conveyance guides provided at both sides of said conveying belt in a widthwise direction thereof in said image recording part, the conveyance guides having a plurality of ribs and recession grooves alternately, each of said ribs and said recession grooves being aligned along a conveying direction of said recording medium; and a belt charging unit provided in contact with said insulating layer in a vicinity of said separating unit so as to charge said insulating layer with a positive charge and a negative charge alternately in a moving direction of said conveying belt by applying an AC bias to said conveying belt, wherein at least one of said driving roller and said driven roller is a grip roller having a plurality of projections.

19. A recording-medium conveying device conveying a recording medium to an image recording part, the recording medium being separated and fed from a recording-medium feeding device by a separating unit thereof, the recording-medium conveying device comprising:

a conveying belt wound around a driving roller and a driven roller so as to convey said recording medium to said image recording part, the conveying belt having a two-layer structure composed of an insulating layer formed at one side contacting said recording medium and a timing belt formed by a conductive layer at the other side not contacting said recording medium; and a belt charging unit provided in contact with said insulating layer in a vicinity of said separating unit so as to charge said insulating layer with a positive charge and a negative charge alternately in a moving direction of said conveying belt by applying an AC bias to said conveying belt, wherein a first length of a path along which the recording medium travels after being separated by the separating unit and until the recording medium contacts the conveying belt is greater than a second length along the conveying belt from a position of the belt charging unit to a position at which the recording medium contacts the conveying belt.

20. The recording-medium conveying device as claimed in claim 19, wherein said timing belt is formed at at least a part of said other side of said conveying belt.

21. A recording-medium conveying device conveying a recording medium to an image recording part, the recording medium being separated and fed from a recording-medium feeding device by a separating unit thereof, the recording-medium conveying device comprising:

a conveying belt wound around a central part of a driving roller and a central part of a driven roller so as to convey said recording medium to said image recording part, the conveying belt being narrower than said recording medium, and having a two-layer structure composed of an insulating layer formed at one side contacting said recording medium and a timing belt formed by a conductive layer at the other side not contacting said recording medium; and conveyance guides provided at both sides of said conveying belt in a widthwise direction thereof in said image recording part, the conveyance guides having a plurality of ribs and recession grooves alternately, each of said ribs and said recession grooves being aligned along a conveying direction of said recording medium; and a belt charging unit provided in contact with said insulating layer in a vicinity of said separating unit so as to charge said insulating layer with a positive charge and a negative charge alternately in a moving direction of said conveying belt by applying an AC bias to said conveying belt.

22. The recording-medium conveying device as claimed in claim 21, wherein said timing belt is formed at at least a part of said other side of said conveying belt.

23. A recording-medium conveying device conveying a recording medium to an image recording part, the recording medium being separated and fed from a recording-medium feeding device by a separating unit thereof, the recording-medium conveying device comprising:

a conveying belt wound around a driving roller and a driven roller so as to convey said recording medium to said image recording part, the conveying belt having a two-layer structure composed of an insulating layer formed at one side contacting said recording medium and a conductive layer formed at the other side not contacting said recording medium;

a belt charging unit provided in contact with said insulating layer in a vicinity of said separating unit so as to charge said insulating layer with a positive charge and a negative charge alternately in a moving direction of said conveying belt by applying an AC bias to said conveying belt; and a pressing roller pressing said conveying belt against said driving roller by exerting an elastic force so as to prevent said conveying belt from slipping on said driving roller, wherein one of said driving roller and said driven roller positioned upstream in a conveying direction of said recording medium has a large diameter, and the other of said driving roller and said driven roller positioned downstream in the conveying direction of said recording medium has a small diameter.

24. A recording-medium conveying device conveying a recording medium to an image recording part, the recording medium being separated and fed from a recording-medium feeding device, the recording-medium conveying device comprising:

a conveying belt wound around a driving roller and a driven roller, the driving roller being connected to a ground, so as to convey said recording medium to said image recording part, the conveying belt having an insulating layer formed at a side contacting said recording medium;

a belt charging unit provided opposite said driving roller at a position upstream in a revolving direction of said driving roller from a position at which said recording medium fed from said recording-medium feeding device contacts said conveying belt wound around said driving roller so as to charge said conveying belt with a positive charge and a negative charge alternately in a moving direction of said conveying belt by applying an AC bias to said conveying belt; and a pressing roller provided opposite said driving roller at a position downstream in the revolving direction of said driving roller from said belt charging unit so as to press said recording medium stuck fast to said conveying belt closely to said conveying belt.

25. The recording-medium conveying device as claimed in claim 24, wherein the AC bias is impressed to said belt charging unit when said recording medium is conveyed.

26. The recording-medium conveying device as claimed in claim 25, wherein said AC bias is not applied to said belt charging unit when said recording medium is not conveyed.

27. The recording-medium conveying device as claimed in claim 24, wherein the AC bias is impressed to said belt charging unit while said conveying belt is continuously revolved, before said recording medium is conveyed.

28. A recording-medium conveying device conveying a recording medium to an image recording part, the recording medium being separated and fed from a recording-medium feeding device, the recording-medium conveying device comprising:

a conveying belt wound around a driving roller and a driven roller so as to convey said recording medium to said image recording part, the conveying belt having an insulating layer formed at at least a side contacting said recording medium; and a belt charging unit provided in contact with said conveying belt and in a vicinity of a separating unit so as to charge said conveying belt with a positive charge and a negative charge alternately in a moving direction of said conveying belt by applying an AC bias to said conveying belt, wherein said insulating layer has a volume resistivity equal to or more than $10^{12}$ Ωcm.

29. A recording-medium conveying device conveying a recording medium to an image recording part, the recording medium being separated and fed from a recording-medium feeding device, the recording-medium conveying device comprising:

a conveying belt wound around a driving roller and a driven roller so as to convey said recording medium to said image recording part, the conveying belt having an insulating layer formed at at least a side contacting said recording medium;

a belt charging unit provided in contact with said conveying belt and in a vicinity of a separating unit so as to charge said conveying belt with a positive charge and a negative charge alternately in a moving direction of said conveying belt by applying an AC bias to said conveying belt; and conveyance guides provided at both sides of said conveying belt in a widthwise direction thereof so as to guide said recording medium, the conveying belt being formed narrower than said recording medium.

30. The recording-medium conveying device as claimed in claim 29, wherein said conveyance guides comprise a plurality of ribs and recession grooves alternately, each of said ribs and said recession grooves being aligned along a conveying direction of said recording medium.

31. A conveyance control device controlling a recording-medium conveying device conveying a recording medium to an image recording part, the recording medium being separated and fed from a recording-medium feeding device by a separating unit thereof, the recording-medium conveying device including:

a conveying belt wound around a driving roller and a driven roller so as to convey said recording medium to said image recording part, the conveying belt having a two-layer structure composed of an insulating layer formed at one side contacting said recording medium and a conductive layer formed at the other side not contacting said recording medium;

a belt charging unit provided in contact with said insulating layer in a vicinity of said separating unit so as to charge said insulating layer with a positive charge and a negative charge alternately in a moving direction of said conveying belt by applying an AC bias to said conveying belt; and a pressing roller pressing said conveying belt against said driving roller by exerting an elastic force so as to prevent said conveying belt from slipping on said driving roller, the conveyance control device comprising:

a binary scale provided on a part of said conveying belt along the moving direction thereof, wherein one of a reflected light and a transmitted light from said binary scale is detected so as to control a revolving velocity and a stopping position of said driving roller, and a first length of a path along which the recording medium travels after being separated by the separating unit and until the recording medium contacts the conveying belt is greater than a second length along the conveying belt from a position of the belt charging unit to a position at which the recording medium contacts the conveying belt.

32. The conveyance control device as claimed in claim 31, further comprising an optical sensor provided opposite a part of said conveying belt downstream from and near said driving roller so as to detect one of said reflected light and said transmitted light.

33. The conveyance control device as claimed in claim 31, further comprising an optical sensor provided opposite a part of said conveying belt corresponding to said image recording part so as to detect said reflected light.

34. A conveyance control device controlling a recording-medium conveying device conveying a recording medium to an image recording part the recording medium being separated and fed from a recording-medium feeding device by a separating unit thereof, the recording-medium conveying device including:

a conveying belt wound around a central part of a driving roller and a central part of a driven roller so as to convey said recording medium to said image recording part, the conveying belt being narrower than said recording medium, and having a two-layer structure composed of an insulating layer formed at one side contacting said recording medium and a conductive layer formed at the other side not contacting said recording medium;

conveyance guides provided at both sides of said conveying belt in a widthwise direction thereof in said image recording part, the conveyance guides having a plurality of ribs and recession grooves alternately, each of said ribs and said recession grooves being aligned along a conveying direction of said recording medium;

a belt charging unit provided in contact with said insulating layer in a vicinity of said separating unit so as to charge said insulating layer with a positive charge and a negative charge alternately in a moving direction of said conveying belt by applying an AC bias to said conveying belt; and a pressing roller pressing said conveying belt against said driving roller by exerting an elastic force so as to prevent said conveying belt from slipping on said driving roller, the conveyance control device comprising:

a binary scale provided on a part of said conveying belt along the moving direction thereof, wherein one of a reflected light and a transmitted light from said binary scale is detected so as to control a revolving velocity and a stopping position of said driving roller.

35. The conveyance control device as claimed in claim 34, further comprising an optical sensor provided opposite a part of said conveying belt downstream from and near said driving roller so as to detect one of said reflected light and said transmitted light.

36. The conveyance control device as claimed in claim 34, further comprising an optical sensor provided opposite a part of said conveying belt corresponding to said image recording part so as to detect said reflected light.

37. A conveyance control device controlling a recording-medium conveying device conveying a recording medium to an image recording part, the recording medium being separated and fed from a recording-medium feeding device, the recording-medium conveying device including:

a conveying belt wound around a driving roller and a driven roller so as to convey said recording medium to said image recording part, the conveying belt having an insulating layer formed at at least a side contacting said recording medium; and a belt charging unit provided in contact with said conveying belt and in a vicinity of a separating unit so as to charge said conveying belt with a positive charge and a negative charge alternately in a moving direction of said conveying belt by applying an AC bias to said conveying belt, the conveyance control device comprising:

a conveyance distance detecting unit detecting one of a conveyance speed and a conveyance distance of said conveying belt; and a conveying-belt driving unit driving said driving roller, wherein said conveying-belt driving unit is controlled according to one of said conveyance speed and said conveyance distance detected by said conveyance distance detecting unit, and a first length of a path along which the recording medium travels after being separated by the separating unit and until the recording medium contacts the conveying belt is greater than a second length along the conveying belt from a position of the belt charging unit to a position at which the recording medium contacts the conveying belt.

38. A conveyance control device controlling a recording-medium conveying device conveying a recording medium to an image recording part, the recording medium being separated and fed from a recording-medium feeding device, the recording-medium conveying device including:

a conveying belt wound around a driving roller and a driven roller so as to convey said recording medium to said image recording part, the conveying belt having an insulating layer formed at at least a side contacting said recording medium; and a belt charging unit provided in contact with said conveying belt and in a vicinity of a separating unit so as to charge said conveying belt with a positive charge and a negative charge alternately in a moving direction of said conveying belt by applying an AC bias to said conveying belt, the conveyance control device comprising:

a conveyance distance detecting unit detecting one of a conveyance speed and a conveyance distance of said conveying belt; and a conveying-belt driving unit driving said driving roller, wherein said conveying-belt driving unit is controlled according to one of said conveyance speed and said conveyance distance detected by said conveyance distance detecting unit, wherein said conveyance distance detecting unit comprises:

a binary scale provided on one of an outer surface and an inner surface of said conveying belt; and a read sensor reading said binary scale, wherein said binary scale has pitches arranged at an interval corresponding to a value obtained by dividing a maximum resolution of an image to be recorded on said recording medium by n, where n is an integer larger than zero.

39. A conveyance control device controlling a recording-medium conveying device conveying a recording medium to an image recording part, the recording medium being separated and fed from a recording-medium feeding device, the recording-medium conveying device including:

a conveying belt wound around a driving roller and a driven roller so as to convey said recording medium to said image recording part, the conveying belt having an insulating layer formed at at least a side contacting said recording medium; and a belt charging unit provided in contact with said conveying belt and in a vicinity of a separating unit so as to charge said conveying belt with a positive charge and a negative charge alternately in a moving direction of said conveying belt by applying an AC bias to said conveying belt, the conveyance control device comprising:

a conveyance distance detecting unit detecting one of a conveyance speed and a conveyance distance of said conveying belt; and a conveying-belt driving unit driving said driving roller, wherein said conveying-belt driving unit is controlled according to one of said conveyance speed and said conveyance distance detected by said conveyance distance detecting unit, wherein said conveyance distance detecting unit comprises an encoder provided on a rotary shaft of said driving roller, wherein said driving roller has a diameter determined such that a conveyance distance of said conveying belt corresponding to one pulse output by said encoder becomes a value obtained by dividing a maximum resolution of an image to be recorded on said recording medium by n, where n is an integer larger than zero.

40. An inkjet recording device comprising:

a recording head in an image recording part so as to record an image by jetting ink drops on a recording medium;

a recording-medium feeding device containing said recording medium, and separating and feeding said recording medium one by one therefrom; and a recording-medium conveying device including:

a conveying belt wound around a driving roller and a driven roller so as to convey said recording medium to said image recording part, the conveying belt having an insulating layer formed at at least a side contacting said recording medium; and a belt charging unit provided in contact with said conveying belt and in a vicinity of a separating unit so as to charge said conveying belt with a positive charge and a negative charge alternately in a moving direction of said conveying belt by applying an AC bias to said conveying belt, wherein a first length of a path along which the recording medium travels after being separated by the separating unit and until the recording medium contacts the conveying belt is greater than a second length along the conveying belt from a position of the belt charging unit to a position at which the recording medium contacts the conveying belt.

41. An inkjet recording device as claimed in claim 40, wherein the recording head is mounted on a carriage in the image recording part, wherein the conveying belt has a two-layer structure composed of the insulating layer formed at one side contacting said recording medium and a conductive layer formed at the other side not contacting said recording medium, wherein the belt charging unit is in contact with said insulating layer in a vicinity of said separating unit so as to charge said insulating layer with a positive charge and a negative charge alternately in a moving direction of said conveying belt by applying an AC bias to said conveying belt, and wherein at least one of said driving roller and said driven roller is a grip roller having a plurality of projections.

42. An inkjet recording device comprising:

a recording head mounted on a carriage in an image recording part so as to record an image by jetting ink drops on a recording medium;

a recording-medium feeding device containing said recording medium, and separating and feeding said recording medium one by one therefrom; and a recording-medium conveying device including:

a conveying belt wound around a driving roller and a driven roller so as to convey said recording medium to said image recording part, the conveying belt having an insulating layer formed at at least a side contacting said recording medium; and a belt charging unit provided in contact with said conveying belt and in a vicinity of a separating unit so as to charge said conveying belt with a positive charge and a negative charge alternately in a moving direction of said conveying belt by applying an AC bias to said conveying belt, wherein a first length of a path along which the recording medium travels after being separated by the separating unit and until the recording medium contacts the conveying belt is greater than a second length along the conveying belt from a position of the belt charging unit to a position at which the recording medium contacts the conveying belt.

43. The inkjet recording device as claimed in claim 42, wherein said belt charging unit applies said AC bias to said conveying belt while said conveying belt conveys said recording medium, and said belt charging unit stops applying said AC bias to said conveying belt while said conveying belt stops conveying said recording medium.

44. The inkjet recording device as claimed in claim 42, wherein said belt charging unit applies said AC bias to said conveying belt while said conveying belt is continuously revolved, before said conveying belt conveys said recording medium.

45. The inkjet recording device as claimed in claim 42, wherein said conveying belt is formed of one layer of said insulating layer.

46. The inkjet recording device as claimed in claim 42, wherein said conveying belt is formed of two layers composed of said insulating layer formed at one side contacting said recording medium and a conductive layer formed at the other side not contacting said recording medium.

47. The inkjet recording device as claimed in claim 42, wherein said recording-medium conveying device further includes a pressing roller pressing said conveying belt against said driving roller by exerting an elastic force so as to prevent said conveying belt from slipping on said driving roller.

48. The inkjet recording device as claimed in claim 47, wherein said pressing roller is provided at a position downstream in a revolving direction of said driving roller.

49. The inkjet recording device as claimed in claim 42, wherein at least said driving roller among said driving roller and said driven roller has a plurality of projections on a surface thereof.

50. The inkjet recording device as claimed in claim 42, wherein said conveying belt is formed of a timing belt.

51. The inkjet recording device as claimed in claim 42, further comprising:

a conveyance distance detecting unit detecting one of a conveyance speed and a conveyance distance of said conveying belt; and a conveying-belt driving unit driving said driving roller, wherein said conveying-belt driving unit is controlled according to one of said conveyance speed and said conveyance distance detected by said conveyance distance detecting unit.

52. An inkjet recording device comprising:

a recording head mounted on a carnage in an image recording part so as to record an image by jetting ink drops on a recording medium;

a recording-medium feeding device containing said recording medium, and separating and feeding said recording medium one by one therefrom by a separating unit thereof; and a recording-medium conveying device including:

a conveying belt wound around a driving roller and a driven roller so as to convey said recording medium to said image recording part, the conveying belt having a two-layer structure composed of an insulating layer formed at one side contacting said recording medium and a conductive layer formed at the other side not contacting said recording medium;

a belt charging unit provided in contact with said insulating layer in a vicinity of said separating unit so as to charge said insulating layer with a positive charge and a negative charge alternately in a moving direction of said conveying belt by applying an AC bias to said conveying belt; and a pressing roller pressing said conveying belt against said driving roller by exerting an elastic force so as to prevent said conveying belt from slipping on said driving roller, wherein a first length of a path along which the recording medium travels after being separated by the separating unit and until the recording medium contacts the conveying belt is greater than a second length along the conveying belt from a position of the belt charging unit to a position at which the recording medium contacts the conveying belt.

53. The inkjet recording device as claimed in claim 52, wherein a surface of said driving roller is cured.

54. The inkjet recording device as claimed in claim 53, wherein the surface of said driving roller is cured by being coated with urethane.

55. The inkjet recording device as claimed in claim 52, further comprising a binary scale provided on a part of said conveying belt along the moving direction thereof, wherein one of a reflected light and a transmitted light from said binary scale is detected so as to control a revolving velocity and a stopping position of said driving roller.

56. An inkjet recording device comprising:

a recording head mounted on a carriage in an image recording part so as to record an image by jetting ink drops on a recording medium;

a recording-medium feeding device containing said recording medium, and separating and feeding said recording medium one by one therefrom by a separating unit thereof; and a recording-medium conveying device including:

a conveying belt wound around a central part of a driving roller and a central part of a driven roller so as to convey said recording medium to said image recording part, the conveying belt being narrower than said recording medium, and having a two-layer structure composed of an insulating layer formed at one side contacting said recording medium and a conductive layer formed at the other side not contacting said recording medium;

conveyance guides provided at both sides of said conveying belt in a widthwise direction thereof in said image recording part, the conveyance guides having a plurality of ribs and recession grooves alternately, each of said ribs and said recession grooves being aligned along a conveying direction of said recording medium;

a belt charging unit provided in contact with said insulating layer in a vicinity of said separating unit so as to charge said insulating layer with a positive charge and a negative charge alternately in a moving direction of said conveying belt by applying an AC bias to said conveying belt; and a pressing roller pressing said conveying belt against said driving roller by exerting an elastic force so as to prevent said conveying belt from slipping on said driving roller.

57. The inkjet recording device as claimed in claim 56, wherein a surface of said driving roller is cured.

58. The inkjet recording device as claimed in claim 57, wherein the surface of said driving roller is cured by being coated with urethane.

59. The inkjet recording device as claimed in claim 56, wherein one of said driving roller and said driven roller positioned upstream in the conveying direction of said recording medium has a large diameter, and the other of said driving roller and said driven roller positioned downstream in the conveying direction of said recording medium has a small diameter.

60. The inkjet recording device as claimed in claim 56, further comprising a binary scale provided on a part of said conveying belt along the moving direction thereof, wherein one of a reflected light and a transmitted light from said binary scale is detected so as to control a revolving velocity and a stopping position of said driving roller.

61. An inkjet recording device comprising:

a recording head mounted on a carriage in an image recording part so as to record an image by jetting ink drops on a recording medium;

a recording-medium feeding device containing said recording medium, and separating and feeding said recording medium one by one therefrom by a separating unit thereof; and a recording-medium conveying device including:

a conveying belt wound around a central part of a driving roller and a central part of a driven roller so as to convey said recording medium to said image recording part, the conveying belt being narrower than said recording medium, and having a two-layer structure composed of an insulating layer formed at one side contacting said recording medium and a conductive layer formed at the other side not contacting said recording medium;

conveyance guides provided at both sides of said conveying belt in a widthwise direction thereof in said image recording part, the conveyance guides having a plurality of ribs and recession grooves alternately, each of said ribs and said recession grooves being aligned along a conveying direction of said recording medium; and a belt charging unit provided in contact with said insulating layer in a vicinity of said separating unit so as to charge said insulating layer with a positive charge and a negative charge alternately in a moving direction of said conveying belt by applying an AC bias to said conveying belt, wherein at least one of said driving roller and said driven roller is a grip roller having a plurality of projections.

62. An inkjet recording device comprising:

a recording head mounted on a carriage in an image recording part so as to record an image by jetting ink drops on a recording medium;

a recording-medium feeding device containing said recording medium, and separating and feeding said recording medium one by one therefrom by a separating unit thereof; and a recording-medium conveying device including:

a conveying belt wound around a driving roller and a driven roller so as to convey said recording medium to said image recording part, the conveying belt having a two-layer structure composed of an insulating layer formed at one side contacting said recording medium and a timing belt formed by a conductive layer at the other side not contacting said recording medium; and a belt charging unit provided in contact with said insulating layer in a vicinity of said separating unit so as to charge said insulating layer with a positive charge and a negative charge alternately in a moving direction of said conveying belt by applying an AC bias to said conveying belt, wherein a first length of a path along which the recording medium travels after being separated by the separating unit and until the recording medium contacts the conveying belt is greater than a second length along the conveying belt from a position of the belt charging unit to a position at which the recording medium contacts the conveying belt.

63. The inkjet recording device as claimed in claim 62, wherein said timing belt is formed at at least a part of said other side of said conveying belt.

64. An inkjet recording device comprising:

a recording head mounted on a carriage in an image recording part so as to record an image by jetting ink drops on a recording medium;

a recording-medium feeding device containing said recording medium, and separating and feeding said recording medium one by one therefrom by a separating unit thereof; and a recording-medium conveying device including:

a conveying belt wound around a central part of a driving roller and a central part of a driven roller so as to convey said recording medium to said image recording part, the conveying belt being narrower than said recording medium, and having a two-layer structure composed of an insulating layer formed at one side contacting said recording medium and a timing belt formed by a conductive layer at the other side not contacting said recording medium; and conveyance guides provided at both sides of said conveying belt in a widthwise direction thereof in said image recording part, the conveyance guides having a plurality of ribs and recession grooves alternately, each of said ribs and said recession grooves being aligned along a conveying direction of said recording medium; and a belt charging unit provided in contact with said insulating layer in a vicinity of said separating unit so as to charge said insulating layer with a positive charge and a negative charge alternately in a moving direction of said conveying belt by applying an AC bias to said conveying belt.

65. The inkjet recording device as claimed in claim 64, wherein said timing belt is formed at at least a part of said other side of said conveying belt.

66. An inkjet recording device comprising:

a recording head mounted on a carriage in an image recording part so as to record an image by jetting ink drops on a recording medium;

a recording-medium feeding device containing said recording medium, and separating and feeding said recording medium one by one therefrom by a separating unit thereof; and a recording-medium conveying device including:

a conveying belt wound around a driving roller and a driven roller so as to convey said recording medium to said image recording part, the conveying belt having a two-layer structure composed of an insulating layer formed at one side contacting said recording medium and a conductive layer formed at the other side not contacting said recording medium;

a belt charging unit provided in contact with said insulating layer in a vicinity of said separating unit so as to charge said insulating layer with a positive charge and a negative charge alternately in a moving direction of said conveying belt by applying an AC bias to said conveying belt; and a pressing roller pressing said conveying belt against said driving roller by exerting an elastic force so as to prevent said conveying belt from slipping on said driving roller, wherein one of said driving roller and said driven roller positioned upstream in a conveying direction of said recording medium has a large diameter, and the other of said driving roller and said driven roller positioned downstream in the conveying direction of said recording medium has a small diameter.

67. An inkjet recording device comprising:

a recording head mounted on a carriage in an image recording part so as to record an image by jetting ink drops on a recording medium;

a recording-medium feeding device containing said recording medium, and separating and feeding said recording medium one by one therefrom; and a recording-medium conveying device including:

a conveying belt wound around a driving roller and a driven roller, the driving roller being connected to a ground, so as to convey said recording medium to said image recording part, the conveying belt having an insulating layer formed at a side contacting said recording medium;

a belt charging unit provided opposite said driving roller at a position upstream in a revolving direction of said driving roller from a position at which said recording medium fed from said recording-medium feeding device contacts said conveying belt wound around said driving roller so as to charge said conveying belt with a positive charge and a negative charge alternately in a moving direction of said conveying belt by applying an AC bias to said conveying belt; and a pressing roller provided opposite said driving roller at a position downstream in the revolving direction of said driving roller from said belt charging unit so as to press said recording medium stuck fast to said conveying belt closely to said conveying belt and so as to press said conveying belt against said driving roller, wherein a first length of a path along which the recording medium travels after being separated by the separating unit and until the recording medium contacts the conveying belt is greater than a second length along the conveying belt from a position of the belt charging unit to a position at which the recording medium contacts the conveying belt.

68. An inkjet recording device comprising:

a recording head mounted on a carriage in an image recording part so as to record an image by jetting ink drops on a recording medium;

a recording-medium feeding device containing said recording medium, and separating and feeding said recording medium one by one therefrom; and a recording-medium conveying device including:

a conveying belt wound around a driving roller and a driven roller so as to convey said recording medium to said image recording part, the conveying belt having an insulating layer formed at at least a side contacting said recording medium; and a belt charging unit provided in contact with said conveying belt and in a vicinity of a separating unit so as to charge said conveying belt with a positive charge and a negative charge alternately in a moving direction of said conveying belt by applying an AC bias to said conveying belt, wherein said insulating layer has a volume resistivity equal to or more than $10^{12}$ Ωcm.

69. An inkjet recording device comprising:

a recording head mounted on a carriage in an image recording part so as to record an image by jetting ink drops on a recording medium;

a recording-medium feeding device containing said recording medium, and separating and feeding said recording medium one by one therefrom; and a recording-medium conveying device including:

a conveying belt wound around a driving roller and a driven roller so as to convey said recording medium to said image recording part, the conveying belt having an insulating layer formed at at least a side contacting said recording medium; and a belt charging unit provided in contact with said conveying belt and in a vicinity of a separating unit so as to charge said conveying belt with a positive charge and a negative charge alternately in a moving direction of said conveying belt by applying an AC bias to said conveying belt, wherein said recording-medium conveying device further includes conveyance guides provided at both sides of said conveying belt in a widthwise direction thereof so as to guide said recording medium, the conveying belt being formed narrower than said recording medium.

70. The inkjet recording device as claimed in claim 69, wherein said conveyance guides comprise a plurality of ribs and recession grooves alternately, each of said ribs and said recession grooves being aligned along a conveying direction of said recording medium.

71. An inkjet recording device comprising:

a recording head mounted on a carriage in an image recording part so as to record an image by jetting ink drops on a recording medium;

a recording-medium feeding device containing said recording medium, and separating and feeding said recording medium one by one therefrom; and a recording-medium conveying device including:

a conveying belt wound around a driving roller and a driven roller so as to convey said recording medium to said image recording part, the conveying belt having an insulating layer formed at at least a side contacting said recording medium; and a belt charging unit provided in contact with said conveying belt and in a vicinity of a separating unit so as to charge said conveying belt with a positive charge and a negative charge alternately in a moving direction of said conveying belt by applying an AC bias to said conveying belt; and a conveyance distance detecting unit detecting one of a conveyance speed and a conveyance distance of said conveying belt; and a conveying-belt driving unit driving said driving roller, wherein said conveying-belt driving unit is controlled according to one of said conveyance speed and said conveyance distance detected by said conveyance distance detecting unit, wherein said conveyance distance detecting unit comprises:

a binary scale provided on one of an outer surface and an inner surface of said conveying belt; and a read sensor reading said binary scale, wherein said binary scale has pitches arranged at an interval corresponding to a value obtained by dividing a maximum resolution of an image to be recorded on said recording medium by n, where n is an integer larger than zero.

72. An inkjet recording device comprising:

a recording head mounted on a carnage in an image recording part so as to record an image by jetting ink drops on a recording medium;

a recording-medium feeding device containing said recording medium, and separating and feeding said recording medium one by one therefrom; and a recording-medium conveying device including:

a conveying belt wound around a driving roller and a driven roller so as to convey said recording medium to said image recording part, the conveying belt having an insulating layer formed at at least a side contacting said recording medium; and a belt charging unit provided in contact with said conveying belt and in a vicinity of a separating unit so as to charge said conveying belt with a positive charge and a negative charge alternately in a moving direction of said conveying belt by applying an AC bias to said conveying belt; and a conveyance distance detecting unit detecting one of a conveyance speed and a conveyance distance of said conveying belt; and a conveying-belt driving unit driving said driving roller, wherein said conveying-belt driving wilt is controlled according to one of said conveyance speed and said conveyance distance detected by said conveyance distance detecting unit, wherein said conveyance distance detecting unit comprises an encoder provided on a rotary shaft of said driving roller, wherein said driving roller has a diameter determined such that a conveyance distance of said conveying belt corresponding to one pulse output by said encoder becomes a value obtained by dividing a maximum resolution of an image to be recorded on said recording medium by n, where n is an integer larger than zero.

* * * * *